US006651393B2

(12) United States Patent
Don et al.

(10) Patent No.: US 6,651,393 B2
(45) Date of Patent: Nov. 25, 2003

(54) CONSTRUCTION SYSTEM FOR MANUFACTURED HOUSING UNITS

(75) Inventors: Lawrence C. Don, Alpharetta, GA (US); Victor Lissiak, Dallas, TX (US)

(73) Assignee: Lorwood Properties, Inc., Alpharetta, GA (US)

( * ) Notice: Subject to any disclaimer, the term of this patent is extended or adjusted under 35 U.S.C. 154(b) by 86 days.

(21) Appl. No.: 09/946,101

(22) Filed: Sep. 4, 2001

(65) Prior Publication Data

US 2002/0170243 A1 Nov. 21, 2002

Related U.S. Application Data

(60) Provisional application No. 60/291,147, filed on May 15, 2001.

(51) Int. Cl.[7] ..... E04H 1/00

(52) U.S. Cl. ..... 52/79.5; 52/79.1; 52/79.2; 52/79.12; 52/79.7; 52/79.9; 52/124.2; 52/270; 52/262; 52/266; 52/236.3; 52/234

(58) Field of Search ..... 52/79.1, 79.2, 52/79.12, 79.7, 79.9, 124.2, 270, 262, 266, 236.3, 234

(56) References Cited

U.S. PATENT DOCUMENTS

| | | | | |
|---|---|---|---|---|
| 3,897,662 A | * | 8/1975 | Fencl | 52/79.2 |
| 4,059,931 A | * | 11/1977 | Mongan | 52/79.12 |
| 5,528,866 A | * | 6/1996 | Yulkowski | 52/79.12 |
| 6,330,771 B1 | * | 12/2001 | Hester, Jr. | 52/234 |

* cited by examiner

*Primary Examiner*—Carl D. Friedman
*Assistant Examiner*—Steve Varner
(74) *Attorney, Agent, or Firm*—Troutman Sanders LLP; Ryan A. Schneider, Esq.

(57) ABSTRACT

The present invention relates to a new type of module in which the floor of the module is integral with the ceiling placement upon the module below it. This invention also provides utilization of temperature top protection a module during shipment. This invention also relates to a construction method where the stabilizing structure for the building including stairs and hallways constructed first, and the module are constructed therein.

13 Claims, 26 Drawing Sheets

CONSTRUCTION SYSTEM FOR MANUFACTURED HOUSING UNITS

RELATED US APPLICATION DATA

This application claims priority from U.S. Provisional Application No. 60/291,147 filed May 15, 2001, incorporated herein by reference.

BACKGROUND OF THE INVENTION

1. Field of the Invention

The present invention relates generally to the modular construction industry, and relates more specifically to a construction system for manufactured housing units, which units can form multi-story structures at a building site.

2. Description of Related Art

The conventional building construction art for years has recognized the cost and efficiency advantages of having construction in most part completed at the manufacturing plant, as opposed to significant construction on-site. "Manufactured housing" as used herein means a virtually complete and finished housing unit, wherein a significant portion of the construction of the unit is completed at the manufacturing plant. In current construction techniques, manufactured housing includes, for example, mobile homes that are built in most part at the factory. The interior partitions, doors, fixtures, equipment, windows, among others, are installed in the mobile home before it leaves the plant. Manufactured housing thus is not meant to include simply modular core constructions with little to no finishing that are shipped to a construction site for finishing and integration into a building structure.

Manufactured housing fills a tremendous need for affordable, single-family housing in rural areas of the country. In fact, manufactured housing accounts for approximately one-third of the total housing starts over the last several years.

Specific advantages and limitations of prior art building construction techniques follows. A first set of points outlines many advantages of manufactured housing, vis-à-vis on-site construction. Conversely, a second set of points illustrates construction applications where onsite construction is preferred over manufactured housing techniques. Typically, a building structure comprises only one of these two types of construction techniques; they are often mutually exclusive. For example, multi-story structures comprises almost exclusively of on-site construction elements. While it is undisputed that costs would be lower and construction efficiencies increased if multi-story structures could comprise in significant portions manufactured housing, the current state of the manufactured housing art does not enable such construction.

Thus, a third set of points are discussed that particularly identify the current limitations and roadblocks of utilizing manufactured housing units in a multi-story structure, as opposed to simply cornering manufactured housing techniques for only single-story modular structures. It is the specific prior art deficiencies of this third set that the present invention primarily addresses and overcomes, such that multi-story structures can indeed comprise in significant portions manufactured housing.

A. Benefits of Manufactured Housing

Manufactured housing as embodied in, for example, the present manufacture of mobile homes offers several advantages over site-built housing construction. In the factory environment:

- Construction can occur year round, regardless of the weather.

- Production in the factory with the use of jigs and assembly line techniques leads to a more uniform product under quality control supervision.
- Assembly line efficiencies enable one man to do more than one task.
- Completion time for construction is reduced.
- Typical factory wages are substantially less than field wages.
- Units are almost fully pre-finished in the factory, so that interior partitions, doors, fixtures, equipment and windows, among others, are installed in the units at the factory.
- Site setup requirements are reduced since the modules are shipped with most of siding, roofing and interior finishes complete.

It is clear from the above non-inclusive list of advantages that generally the more construction carried out at the manufacturing floor, the better. Yet, present manufactured housing has its limitations.

B. Benefits of On-Site Construction

Site-built construction conventionally is preferred over manufactured housing for multistory structures. Several reasons for this include:

- Flexibility in design without being restricted to the use of "rectangular" rooms or sections.
- Compliance with current building and life-safety codes that typically require the use of materials such as concrete and steel that are stronger and less flammable than wood, and thus more expensive and time consuming to ship to the site as complete.
- The perception that manufactured housing as it relates to multi-story structures is simply "stack-a-shack" construction.

C. Limitations of Manufactured Housing with Multi-Story Structures

It is known only in some very specific and limited applications to use manufactured housing elements in a multi-story structure. Yet only a very few of the advantages attributable to manufactured housing reside in these limited applications:

- Each manufactured housing unit is typically built with a separate floor and ceiling. Thus, when stacking units one atop another at the site, the floor on an upper unit is set upon the ceiling of a lower unit. This results in a redundant doubling of the number of structural joist members. This is unlike conventional on-site construction that uses the same joist members for both the upper floor and the lower ceiling between two modules.
- According to most building and life-safety codes, it is prohibited from building wood structures over three stories in height. For a building to have more than three stories, steel or concrete structural members typically must be used. This additional building height requires supporting structural members in a diversity of sizes. For example, the lower floors typically require wider vertical members with varying spacing. Concerns about the weight, shear, and wind loads as more floors are added put even greater emphasis on the positioning of the exterior load bearing walls, thus reducing the flexibility in floor plan design.
- The use of concrete for a manufactured housing unit's walls and floors necessitates time-consuming form preparation with more complicated handling considerations. Typically, the units are smaller, thus requiring several units per floor in a building. This increases transportation costs along with the need for more material per floor.

Steel is easier than concrete to use in a manufacturing plant. The art is well developed in the use of steel for building multi-story structures. However, the typical assembly techniques utilizing steel have limited the amount of the manufactured housing unit's interior and exterior finish that can be completed in the factory. For example, the art has heretofore relied heavily on welding to connect most of the structural steel elements that are required in a multi-story building. Welding units together on-site is very cumbersome and can generate heat and sparks that can easily damage any factory-constructed interior or exterior finish that is near the joint to be welded. Thus, truly finished manufactured housing units cannot be used in such building techniques.

A major portion of the construction of a modular-built, multi-level structure still is completed at the site. Most of the exterior finish is not completed until the manufactured housing units are set because of the access required by men and machine to attach the units together, both horizontally and vertically, which access would destroy a factory-constructed exterior finish.

Multi-story modular buildings are typically erected by first setting the manufactured housing units in place both horizontally and vertically, and then building and attaching connecting breezeways, corridors and stairs. This progression of setting the units first prior to breezeways, corridors and stairs) creates its own four distinct problems.

(1) The more units that are used (especially the higher the units are stacked), the more difficult it is to keep each subsequently higher unit level and plumb.

(2) For buildings exceeding two floors, it is very difficult to maneuver each unit into place at the site. Although a crane can come close to setting a module fairly accurately on top of another module, it typically requires construction workers around the perimeter of the module to pull, push and adjust the alignment of the upper module, which can further compromise the exterior finish of a unit.

(3) Beyond two stories, it becomes very difficult just to get workers to the necessary exterior surfaces to attach the units to each other.

(4) Because the connecting corridors and stairs are erected after the units are set, the exterior sides of the modules that abut the halls and stairs can not be finished in the plant because of the potential for damage as the stairs and corridors are built on site, thus necessitating more on-site construction.

These problems effectively negate the savings and efficiencies realized with construction in a manufacturing plant.

Prior Art References

Several designs for floor/ceiling units are disclosed representatively in U.S. Pat. Nos. 1,886,962, 3,510,997, 3,724,141, 4,211,043 and 5,575,119. Each of these designs are basically hybrid panelized construction methods; that is, the floor of an upper unit functions as the ceiling for a lower unit just as conventional on-site construction builds multi-story structures. One can go to any construction site where a multi-floor complex is being built and watch as one floor is built over another over another. Yet, in such prior art designs, the floors and ceilings of the manufactured housing units are not substantially finished at the factory, but on-site. Thus, these conventional panel assemblies still require extensive finishing at the site, including wall and ceiling finishes, floor coverings and installation of cabinets and fixtures. Further, a majority of these panels are built from concrete, a very difficult material to use for mass production.

Conceptually, a major portion of U.S. Pat. No. 4,202,339 to Fisher addresses the prior art problems of the redundancy of materials in a floor/ceiling combination. Fisher addresses the redundancy of materials by proposing the use of "U-shaped" and "Tubular" modules that are to be stacked. Theoretically, where a "U-shaped" module is stacked upon another "U-shaped" module, the horizontal portion of the upper "U" acts as a ceiling for the lower "U".

However, because the modules are presumably shipped to the site on standard flatbed carriers, the ceiling portion of the upper "U" can not be finished, for example, painted or stippled, until after the modules are erected on site. Accordingly, since the ceiling needs to be finished at the site, the degree of factory finishing of the walls, floors and fixtures is limited because of the potential damage to these areas while the ceilings are being shipped and completed. Although this proposed modular construction method theoretically eliminates the redundancy of wall and floor/ceiling materials, it does very little to take advantage of the pre-finishing opportunities that factory construction offers.

Fisher provides no details regarding the make up of the "floor" (the horizontal section) of each "U-shaped" module. Further, the reference is silent as to how the pre-finished "U-shaped" module can be shipped other than "it can be braced during transportation". Regarding the amount of factory work, or pre-finishing, possible with this design, Fisher broadly notes that "the modules are pre-finished as much as possible in the factory; exactly how much depends upon the specific manufacturer". Lastly, Fisher is similarly limited when it comes to the types of pre-finishing that can be completed at the factory as the "tube-shaped module 34 is pre-finished with a textured surface or other desired surface to form the ceiling for the room beneath", yet provides no specific examples on how this could be done. For example, how could such a pre-finished surface be shipped without sustaining damage during shipping? How could such a pre-finished surface be erected at site without sustaining damage while being placed into the proper alignment?

It thus can be seen that a need yet exists for a floor/ceiling assembly that avoids the redundancy of materials for prior art floors and ceilings of stacked units, and enables finishing of the assembly at the plant, rather than on-site.

The success of manufactured housing construction also is limited in view of the prior art deficiencies in providing adequate load-bearing systems that can accommodate the load pressures of stacked units. Typically, the walls of the unit must be significantly thick so as to bear the weight of the structure, or obtrusive exterior or interior load-bearing pillars must be used in connection with panels of the module. Yet, significantly thick walls on manufactured housing units would lead to soaring transportation costs, while load-bearing pillars are unsightly.

Prior art references disclose the use of vertical steel tubing in combination with the units to provide the load-bearing capacity. U.S. Pat. Nos. 3,925,679 and 4,592,175 disclose tubing assemblies that primarily act as reinforcing agents in the walls of the unit. U.S. Pat. Nos. 3,927,498 and 5,755,062 disclose building techniques wherein the tubes basically are used as framework to which wall and floor panels are attached. U.S. Pat. No. 4,470,227 makes use of angle iron only as temporary exterior bracing.

U.S. Pat. Nos. 4,723,381 and 5,528,866 propose the use of exposed vertical structural steel members for the exterior support of the assemblies. Yet such a method of construction is contrary to manufactured housing as the proposed external supports lack the practical considerations of aesthetics, exposure to the elements, and code restrictions.

It thus can be seen that a need yet exists for a load-bearing assembly that can accommodate the load pressures of stacked units, thus freeing the exterior walls from a majority of this support.

Present interconnection techniques between adjacent modules utilize welding. Welding is used to connect most of the structural steel elements that are required in a multi-story building. Yet, welding is very cumbersome and generates heat and sparks that can easily damage any finish that is near the joint to be welded, nearly eliminating the capability of using fully-finished modular units in a multi-story structure. U.S. Pat. No. 3,927,498 illustrates the prefabricated panels being fastened to the vertical support tubes with bolts, but the bolts are exposed to the interior of the structure. Further, the bolts can not act as assembly guides because they are not fixed in position, nor are they used for the purpose of interconnecting independent structures.

U.S. Pat. No. 4,592,175 also discloses the use of bolts to connect the stacked modules both horizontally and vertically. The connection of one unit on top of another is accomplished by aligning pre-drilled holes in the base channel for the top unit to the holes in the rear plate on the bottom unit. Horizontally, "side plates" with pre-drilled holes are welded to the floor channels that are bolted together as the channels abut. These connections are made from the exterior of the module. The connections then need to be covered (hidden) by applying "any desired facade" at the site.

U.S. Pat. No. 5,761,862 relates to the construction of buildings using "pre-formed concrete sections". This is basically a panelized system using concrete sections. The walls, floors and roofs are slabs that are put together at the site. There are primarily two types of connections. One is a vertical connection for two wall sections, and the other is a rod placed into holes that align the walls vertically on top of each other. None of the surfaces are pre-finished, and as with any panel system, no fixtures are pre-installed.

It thus can be seen that a need yet exists for an interconnection assembly to connect the units at the site, which interconnection assembly does not inhibit the pre-finishing of all of the interior and exterior walls.

There exists prior art attempting to overcome the disadvantages associated with multistory modular construction, wherein the modules are first set in place both horizontally and vertically, and then connecting breezeways, corridors and stairs are built around them. This progression of setting the modules first presents stabilization problems. U.S. Pat. No. 3,830,026 relates to a staircase that is "fabricated only from a relatively small number of pre-cast or pre-formed substantially planar slabs and a plurality of pre-formed stairways having risers and treads". U.S. Pat. No. 3,927,518 discloses prefabricated stairs for multi-story buildings. Neither of these references teach or suggest a complete core assembly that includes the stairs in addition to, for example, the hallways, utility rooms and elevator shafts. An additional limitation of the above staircases is that the construction of the main building will still require the use of some scaffolding and ladders, wherein a complete core assembly could eliminate such expense and time.

Therefore, it can be seen that a need yet exists for a stabilization assembly that provides a way to effect the erection of the units without damaging the pre-finished units. It can further be seen that a need certainly exists for a manufactured housing unit construction system capable of providing solutions to the above-identified problems of conventional multi-story modular construction. It is to such a construction system that the present invention is primarily directed.

SUMMARY OF INVENTION

Briefly described, in its preferred form, the present invention provides interrelated embodiments of a construction system for a multi-story structure comprising manufactured housing units that enables the finishing and completion of considerably more of the housing unit at the manufacturing plant (as opposed to on-site construction) than is presently available. A housing unit may refer to a permanent housing structure such as condominiums and apartments, and more temporary housing like motels and hotels.

The present invention discloses construction techniques for "manufactured housing units" so as to distinguish the present "units" from the rather broad term "modules" as used in the art. "Module" is used in the art to denote any standardized unit of measurement, and thus open to numerous interpretations. For example, the present manufactured housing units are distinguishable from "modular utility core units" that are well known and have been used in hybrid site construction for years. The manufactured housing units of the present invention are finished and habitable units, and not simply blocks made up of panels. The present units as described are preferably units of residential housing used in connection with, among others, apartments, condominiums, student housing, assisted care residences, motels and hotels.

The present construction system comprises a floor/ceiling assembly, which floor/ceiling assembly avoids the redundancy of materials for prior art floors and ceilings of stacked modules by providing a ceiling membrane made from gypsum, for example, attached to the floor joists of a unit in the plant. Another distinction between the present floor/ceiling assembly and the prior art attempts at such assemblies is the extent that the prior art units must be finished on-site versus completion in the factory. Further, the floor/ceiling assembly can be constructed out of building materials that are familiar to a typical manufacturer, in the case of present modular housing, the use of steel and gypsum board. The present floor/ceiling assembly concurrently required the development of a way to be able to finish the underside of the floor/ceiling assembly, while still being able to ship it and erect it at the site without damage to the very finishing completed at the factory.

The floor/ceiling assembly additionally comprises an interconnection assembly to connect the units at the site, which interconnection assembly does not inhibit the pre-finishing of the interior and exterior walls. The floor/ceiling assemblies are interconnected at the site at only strategic interior locations, without the use of welding. This allows the exterior walls to be almost completely finished in the plant rather than at the site. Furthermore, the use of the temporary top assembly as a lifting frame eliminates the need for the conventional steel bands around the exterior shell. These prior art steel bands inhibit the finishing of the exterior walls in the plant since the steel bands tend to dig into and distort any finish in which they come in contact.

The present invention further provides a load-bearing assembly that can accommodate the load pressures of stacked units, thus freeing the exterior walls from this support. The present load-bearing assembly is unlike the prior art as it incorporates tubes that are the supporting structural element themselves, with no involvement of the walls. Engineered vertical steel tubes (pipes), preferably all of one size, are strategically placed around the perimeter of the floor/ceiling system. These tubes provide the bearing strength for loads that result from the stacking of the units. Accordingly, all interior and exterior walls are non-load bearing walls. This allows for the units' walls to be located wherever they are of most use based solely on the aesthetics and functionality of the desired floor plans.

The present invention further comprises a removable and reusable temporary roof for the protection of the interior of the virtually completely finished manufactured housing unit as it is without a permanent ceiling. The roof is attached to a unit at the same connection points that are used for the vertical connection of the units atop each other at the site. Lifting eyes can be attached to the roof allowing the roof to be used effectively as a lifting device in lieu of other conventional banding or frame techniques. The roof maintains the structural integrity of the unit during the stressful lifting process. This top is temporarily attached to the unit in such a way as to add rigidity to the unit during transit in order offset the stresses of racking and shearing.

The present further comprises a permanent roof assembly for those modules that will make up the top floor of the structure.

Further, the present construction system comprises a stabilization assembly. The stabilization assembly provides a way to effect the erection of the units without damaging the pre-finished units. A free standing, self-supporting hallway/stair assembly can be built at the site before the units are erected. The present multi-story stabilization assembly solves the four problems identified above with the progression of setting the units first, without any stabilizing structure.

(1) Since the stabilization assembly is in place with its supporting structural members already leveled and plumbed, the stabilization assembly acts as an effective guide to which the units are attached (2) Workers can stand on the stabilization assembly to be in a position to maneuver the units into alignment with each other.

(3) The connections required to attach the units together can be accomplished primarily from the interior of the units. Access to the interiors of the units is facilitated by the walkways as they are already in place at each level. The units that abut the stabilization assembly can be attached directly to the stabilization assembly, such attachments enhancing the stability and strength of the units.

(4) Since walkways and stairs have been built prior to the erection of the units, a greater majority of the exterior surfaces of the units that abut the stabilization assembly can be finished in the plant.

The present construction system can be used during the construction of but a single story structure, but provides numerous efficiencies and benefits when utilized with multi-story structures, more specifically with the construction of structures of at least three stories. This preference of structure stories will be understood by those of skill in the art upon review of the drawings and detailed description.

Further, while the manufactured housing units of the present invention can be built of conventional materials, the present construction system provides numerous efficiencies and benefits when utilized with units that comprise a majority of non-wood and/or non-cement infrastructure, wherein wood and/or cement make up a majority of the infrastructure of conventional units. For example, in a preferred embodiment of the present invention, the manufactured housing units comprise a mainly steel infrastructure. This preference of the material make up of the units will be understood by those of skill in the art upon review of the drawings and detailed description.

One of the benefits of the present system is the ability to "pre-finish" more of the unit at the manufacturing plant. While it is understandably difficult to label the present invention as enabling the finishing and completion of considerably more of the housing unit at the manufacturing plant (as opposed to on-site construction) than is presently available, the Applicants believe that the line (of how much more finishing can be completed with the present invention than allowable in the present art). In another attempt to define the abilities of the present invention, the present construction system enables approximately a majority of the unit to be pre-finished at the manufacturing plant, which is not possible in current building techniques save for mobile home construction. The approximately a majority of pre-finishing is preferably related to the amount of exterior finishing of the unit, but can also relate to the amount of interior finishing of the unit, or both combined. This preference of the amount of pre-finishing will be understood by those of skill in the art upon review of the drawings and detailed description.

It is an object of the present invention to overcome the problems of traditional modular construction wherein each modular unit is built with a separate floor and ceiling.

It is a further object of this invention to build manufactured housing units that are capable of stacking one upon another, wherein the floor of an upper unit can be hooked with the ceiling of a complementary lower unit.

Another object of the present invention is to develop manufactured housing units that can be stacked at least three stories high.

It is a further object of the present construction system to overcome the problem of traditional modular construction wherein the lower floors of a multi-story structure require vastly wider vertical members with varying spacing to support the upper floors. Concern about the weight, shear, and wind loads as more floors are added puts greater emphasis on the positioning of the exterior load bearing walls, thus reducing the flexibility in floor plan design.

An object of this invention is to utilize steel in the construction of housing units that are to be stacked over three stores in height, the steel capable of minimizing the amount of welding that is necessary to tie units together.

Yet another object of the present invention to maximize the amount of housing unit construction at the plant, instead of on-site. Presently, most of the exterior finish is not completed until the modules are set at the site because of the typical access required at the site to attach the modules together, both horizontally and vertically. With steel modular construction, this accessibility is even more essential since structural steel members are typically welded together.

Another object of the present invention is to provide a free standing, self-supporting hallway/stair (stabilization assembly) built at the site before the units are erected that would solve the problem of instability in present modular structures being, for example, more than three stories in height.

Yet another object of the present invention is to develop a construction system for manufactured housing units wherein the corridors and stairs are erected before the units are set.

These and other objects, features and advantages of the present invention will become more apparent upon reading the following specification in conjunction with the accompanying drawing figures.

DETAILED DESCRIPTION OF A PREFERRED EMBODIMENT

Figure 1:
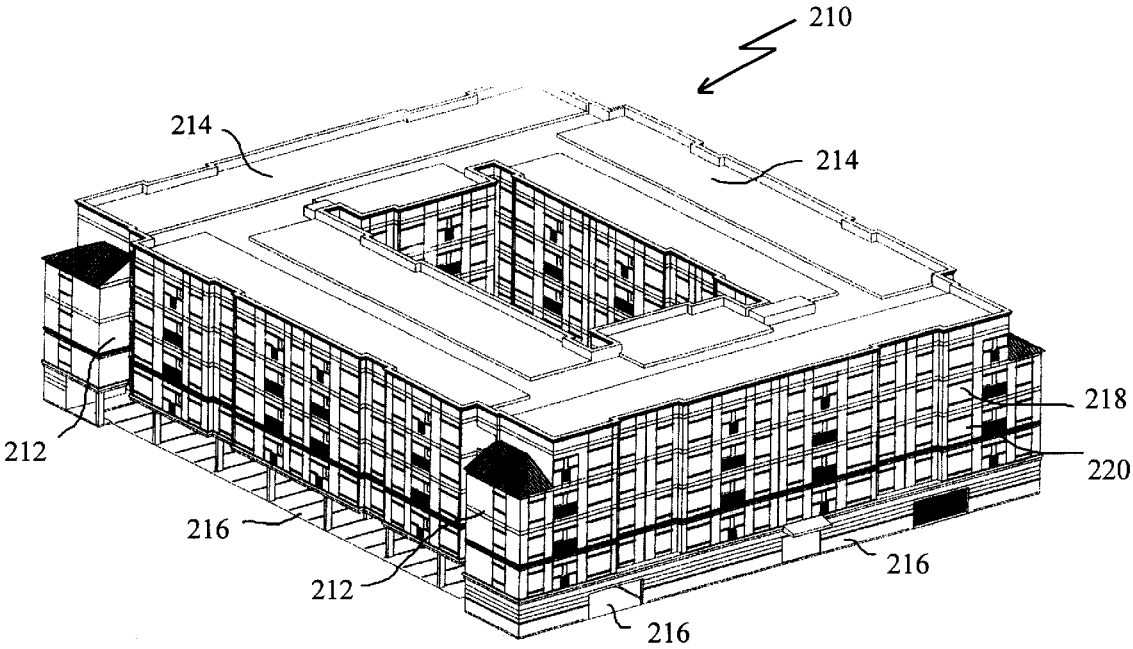
FIG. 1 illustrates a building according to the preferred embodiment of the present construction system.

Referring now in detail to the drawing figures, wherein like reference numerals represent like parts throughout the several views, FIG. 1 illustrates a preferred embodiment of a building 210 built according to the present construction system for manufactured housing units. As will be described in detail, the present construction system for manufactured housing units comprises a floor/ceiling assembly 10, a load-bearing assembly 60, a temporary lifting/transportation roof assembly 80, a permanent roof assembly 140, and a stabilization assembly 170.

The exemplary building 210 of FIG. 1 is a 4-story apartment structure made up of 96 one and two-bedroom residential units. Each apartment itself comprises two modular units that are assembled and pre-finished in a factory distantly located from the construction site. The 192 modules (making up the 96 units) are shipped to the site where they can be lifted by crane and set at an appropriate location to create building 210. After the generic stucco exterior walls 212 and the generic membrane roof 214 have been finished at the mating lines of the modules, apartment building 210 will look similar to any traditionally "stick-built" structure. To further enhance the marketability of building 210, the apartments have been set over a secure parking deck 216. As used herein, an upper floor module 218 is so-called as it is atop a lower floor module 220 in building 210. It will be understood that distinctions between modules 218 and 220 are relative, as a once described upper floor module 218 may in a second reference be identified as a lower floor module 220 to yet a third module.

Figure 2:
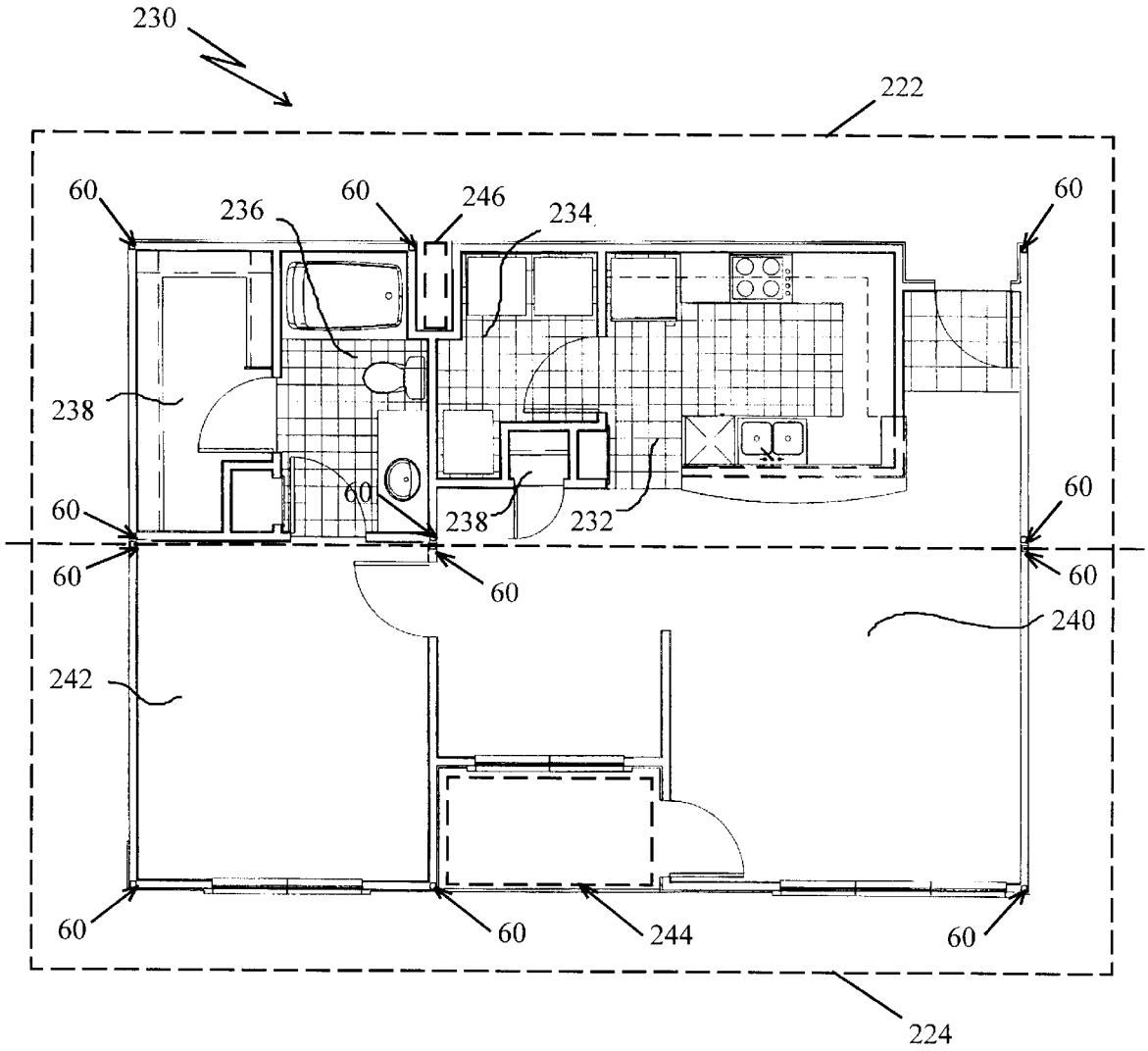
FIG. 2 illustrates the floor plan of a one-bedroom unit for the building of FIG. 1.

A typical one-bedroom apartment 230 of the building 210 is illustrated in FIG. 2 comprising two modules, a "wet" module 222 and a "dry" module 224. As used herein, a "wet" module 222 is so designated because it contains the plumbing lines and fixtures, and accordingly, the "dry" module 224 contains no plumbing lines or fixtures. The one-bedroom apartment 230 floor plan shown in FIG. 2 representatively features a kitchen 232, laundry room 234, bathroom 236, closets 238, living and dining areas 240, bedroom 242, and exterior balcony 244.

The modules 222, 224 are preferably approximately a majority pre-finished, approximately at least a majority-finished, in the manufacturing factory distant the eventual building site. This majority-finishing preferably includes the finishing of both sides of the interior and exterior walls, the floors and the ceilings. Further, the plumbing and electrical lines preferably are pre-installed at the factory with terminations at a mechanical chase 246 for inter-floor connection at the site. In addition, the HVAC ducting can pre-installed with connections to the built-in air handler. Likewise, many, if not most, of the cabinets, fixtures, appliances, doors and windows can pre-installed at the factory.

Figure 3:
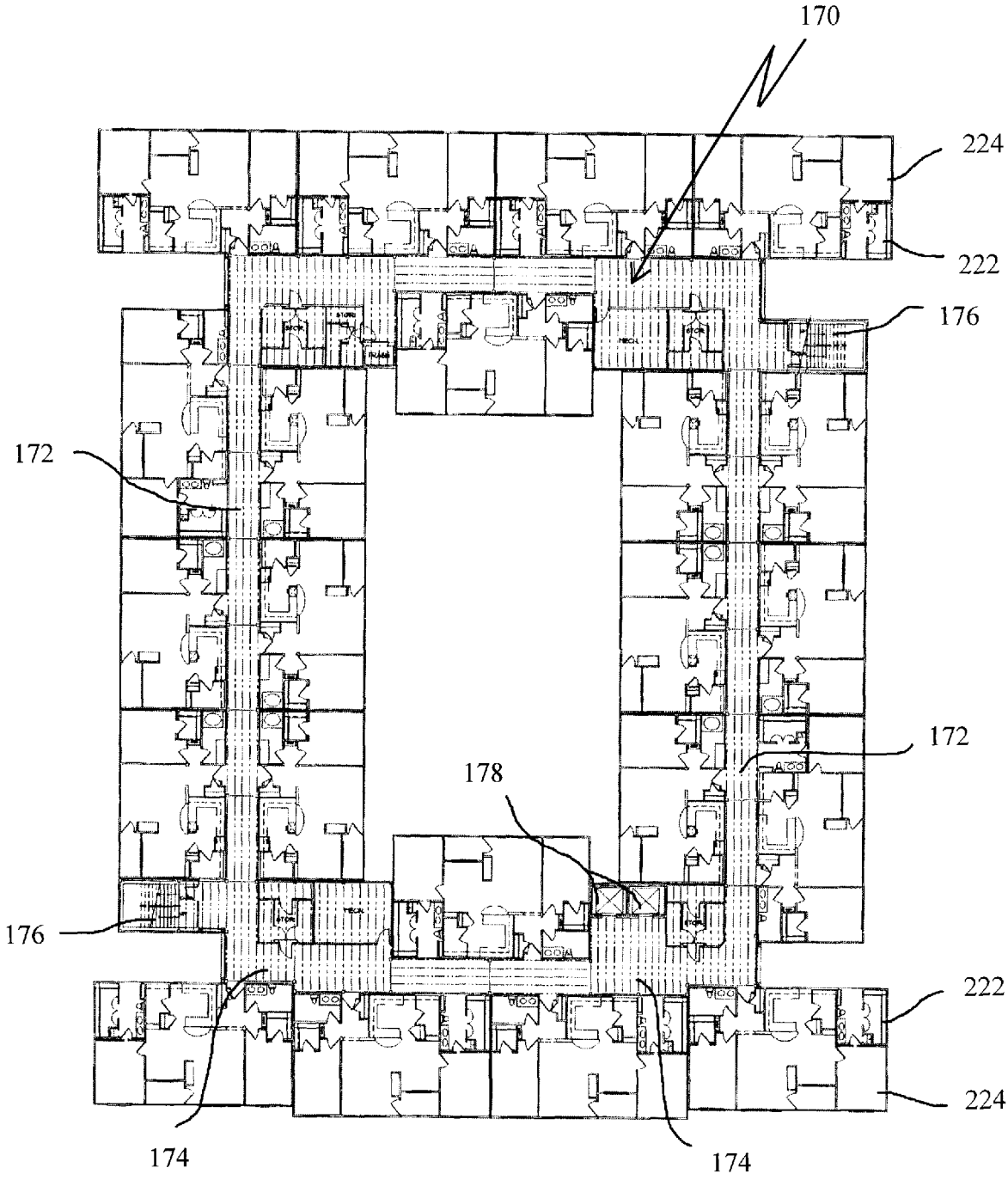
FIG. 3 illustrates a building plan for a floor in the building of FIG. 1.

A typical building floor plan for building 210 is illustrated in FIG. 3. The "wet" modules 222 are placed against and attached directly to the stabilization assembly 170 of the present invention. The "dry" modules 224 are then placed against and attached to the previously set "wet" modules 222. On this particular floor of building 210, various components of the stabilization assembly 170 are shown, including corridors 172, corridor landings 174, and stairs 176. Also shown as part of this building are two elevators 178.

Under this general backdrop, the several elements of the present construction system will be described, and then a discussion of the construction of building 210 will follow.

I. Floor/Ceiling Assembly

The present construction system for manufactured housing units preferably comprises a floor/ceiling assembly 10, which floor/ceiling assembly 10 reduces, if not avoids, the redundancy of materials necessary in the construction of conventional floors and ceilings of stacked units. The floor/ceiling assembly 10 is designed to limit the duplication of costly structural members that traditionally occurs with modular construction, as each modular unit typically is built with a separate floor and ceiling.

The addition of a ceiling in the factory provides a weather barrier during transit so that the interior of the module can be pre-finished. The ceiling also provides structural stability during the transport of the module from the factory to the erection site. Both the "stick-built" and modular construction methods for a multi-floor building require substantial floor joists to accommodate the various live and dead loads. Modular construction requires even greater joist strengths because the spans are typically long (12 to 16 feet wide modules) and, thus, the floor must provide extra rigidity during transit. Similar ceiling spans also require stronger and more costly joists. Because of the additional strength requirements of the joists, the use of a separate floor and ceiling in modular construction can cost over twice as much as the single floor/ceiling combination that is used in "stick-built" construction.

The present invention successfully transforms the idea of the single floor/ceiling combination that is used in "stick-built" construction to the realm of manufactured housing. As more particularly shown in FIG. 4, the floor/ceiling assembly 10 of the present construction system preferably comprises perimeter members 12 in combination with interior members 14, a floor 16, sound attenuation members 18 and ceiling 20. It will be understood that the present floor/ceiling assemblies 10 of an upper unit 218 will also be the ceiling for a lower unit 220. The floor/ceiling assemblies 10 can further comprise a balcony portion 28 having a layer 38 of water-resistant material and a waterproofing membrane system 40 applied to the floor 16. Additionally, the floor/ceiling assemblies 10 can comprise an interconnection system 50 to join two floor/ceiling assemblies 10 that are part of two adjacent modules, together.

Figure 4:
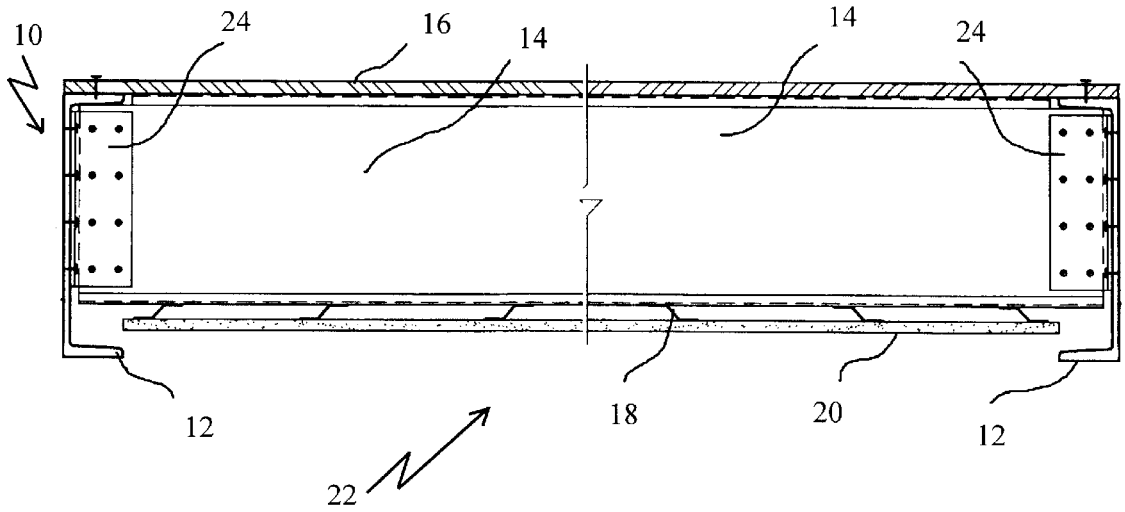
FIG. 4 illustrates a preferred embodiment of the present floor/ceiling assembly of the present invention.
Figure 5:
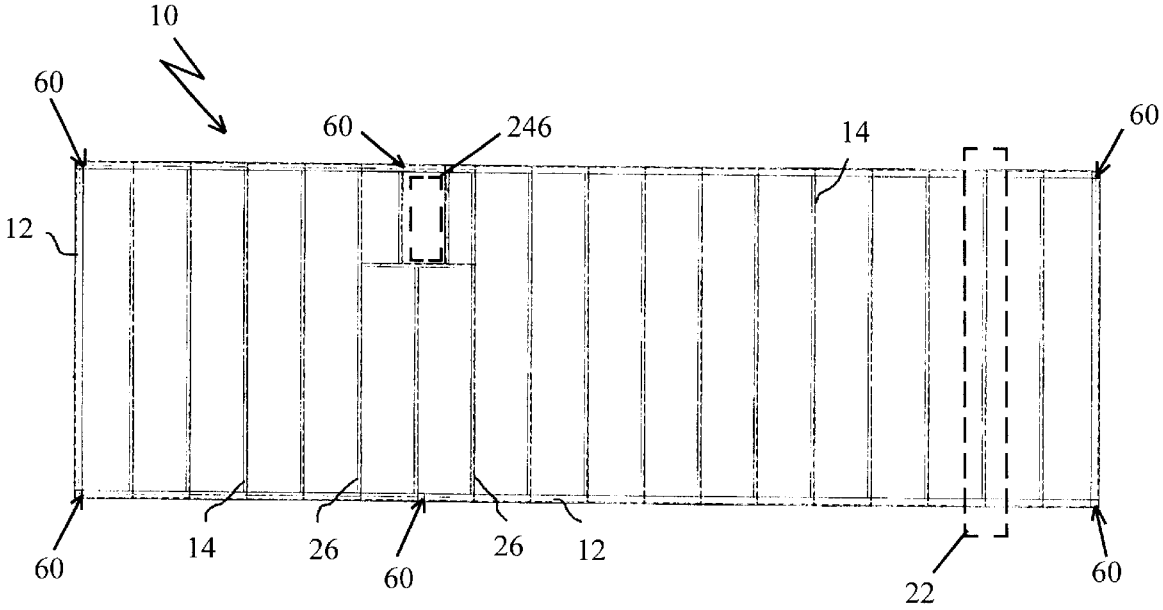
FIG. 5 illustrates a plan view of the structural members of one embodiment of the floor/ceiling assembly of the present invention.

FIG. 5 illustrates a plan view for the framing of the floor/ceiling assembly 10 of FIG. 4 for a "wet" module 222. The perimeter members 12 can be perimeter joists 12, and the interior members 14 can be interior joists 14, each of sufficient size and design. For example, the perimeter joists 12 can be C15×33.9 structural steel channels, and the interior joists 14 can be 12"–16 ga steel channels. The interior joists 14 commonly are located 24" o.c. Joists 12, 14 can comprise any suitable material, but are described as formed of steel because most codes at the present time require steel's use in buildings over three stories in height. Except where specifically noted herein, the steel fabrication (splices, connections, etc.) is constructed in accordance with established techniques familiar to those active in this art.

The location of the floor/ceiling assembly 10 of FIG. 4 is identified in sectional view 22 in FIG. 5. The top flange of the interior joist 14 can be coped so that the surfaces of the flanges on both joists 12 and 14 when joined are on the same plane. Joist 14 is shown attached to joists 12 at 90 degree angles using 16 ga clip fasteners 24. A wood floor 16 can be fastened in accordance with applicable codes to the top flanges of the steel joists 12, 14. In one embodiment, the floor 16 is formed of ¾" T&G plywood screwed and glued to the top flanges of the steel joists.

Sound attenuation members 18 aid with sound attenuation vertically between the modules, and can be resilient channels 18 screwed to the bottom flanges of the interior joists 14. The ceiling 20 can comprise any suitable material, for example, sheets of ⅝" gypsum (type, number or layers and thickness of each depending on code), which sheets are screwed to the resilient channels 18. The gypsum ceiling 20 can be pre-finished in the factory with tape, mud, and paint. In one embodiment, the ceiling 20 can be cut to terminate approximately 4" from the web of the perimeter joists 12 to allow access for making the inter-module connections.

The finished face of the ceiling 20 preferably is recessed above the bottom flange of the perimeter joists 12. Besides facilitating access to the inter-module connection points, both horizontally and vertically, recessing the ceiling 20 allows the placement at the factory of a temporary and disposable covering (not shown) over the finished surface of the ceiling to protect it during transit to the construction site. Also not shown in FIG. 4 are the pipes, ducts, insulation, wiring, carpet, pad, etc. that can be parts of the pre-finished floor/ceiling assembly 10 when it leaves the factory.

There are some variations between the floor/ceiling assemblies 10 used in connection with, on the one hand wet modules 222, and on the other hand dry modules 224. For example, the mechanical chase 246 in wet module 222 is identified in FIG. 5. For additional strength, two heavier 12"–12 ga steel channels 26 are on each side of the area adjacent to mechanical chase 246.

Figure 6:
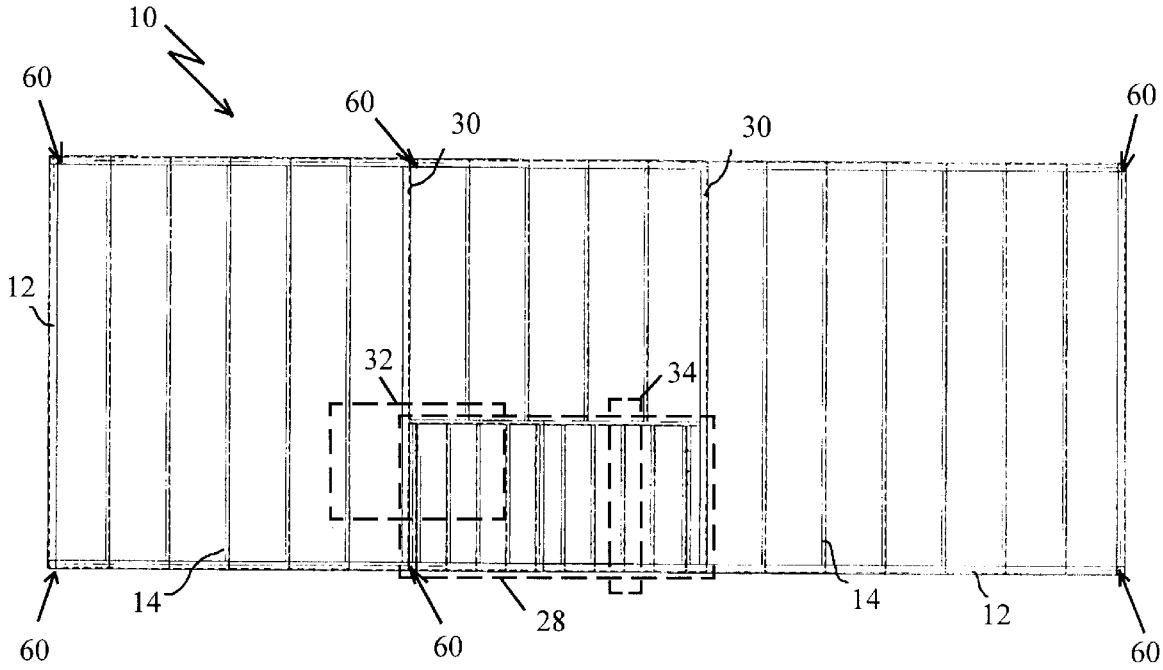
FIG. 6 illustrates a plan view of the structural members of the floor/ceiling assembly of FIG. 5 including a balcony.

FIG. 6 illustrates a plan view for the framing of the floor/ceiling assembly 10 for dry module 224. As with the framing for module 222 as illustrated in FIG. 5, the perimeter joists 12 are C15×33.9 structural steel channels and the interior joists 14 are 12"–16 ga steel channels. Yet, the floor/ceiling assembly 10 for module 224 further comprises a balcony portion 28. Because the balcony portion 28 of floor/ceiling assembly 10 will be open to the environment upon construction of the module, this balcony portion 28 of the floor/ceiling assembly 10 should be weatherproofed and sloped so that any water can be drained. For additional strength at balcony portion 28, two heavier C12×20.7 structural steel channels 30 can be used on each side of the balcony portion.

Figure 7:
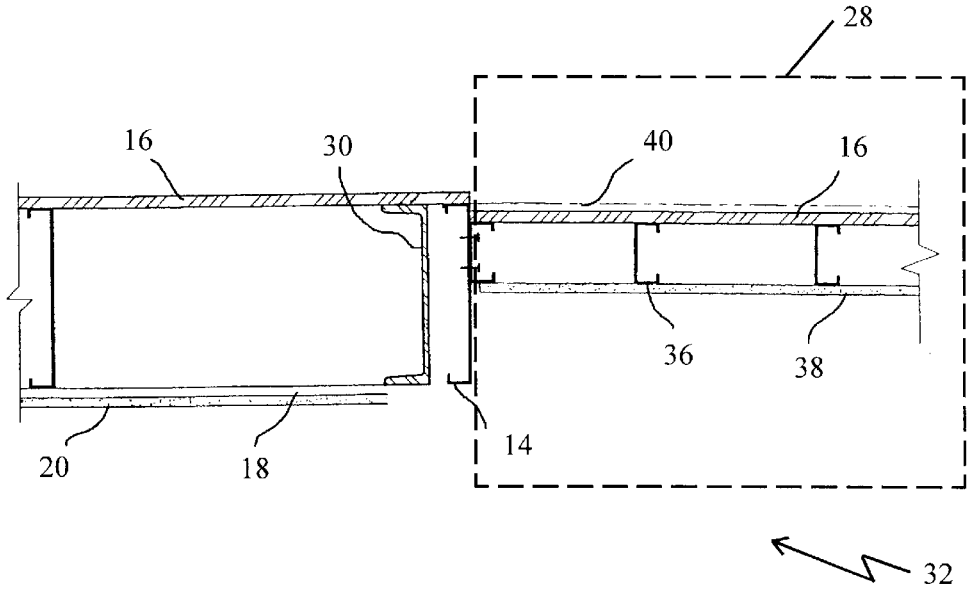
FIG. 7 illustrates the structural details of a section of the balcony of FIG. 6.

Sectional view 32 of balcony portion 28 is identified on FIG. 6, wherein FIG. 7 illustrates the details and components of the floor/ceiling assembly 10 at sectional view 32. As shown, one interior joist 14 has been replaced with the heavier channel 30. For the portion of the floor/ceiling assembly 10 that remains part of the interior of module 224, floor 16, resilient channels 18 and ceiling 20 have been attached and the assembly 10 has been pre-finished as detailed in FIG. 4. Balcony joists 36 can be utilized and, for example, can be 4"–16 ga steel channels set at 12" o.c. Where the balcony joists 36 are attached to the interior joists 14, the top flanges of the balcony joists 36 can be set about one inch below the top flanges of the interior joists. The balcony joists 36 can be set so that there is a downward slope from the sides and back of the balcony to its center and front. Floor 16 is attached to the balcony joists 36 by, for example, gluing and screwing to the top flanges of the balcony joists 36. Preferably, a layer(s) 38 of water-resistant gypsum (number of layers and thickness of each layer as specified by the appropriate code) is screwed directly to the bottom flanges of balcony joists 36. Additionally, a membrane system 40, preferably a waterproofing system, is applied to the top of floor 16 in accordance with the specific manufacturer's instructions.

Figure 8:
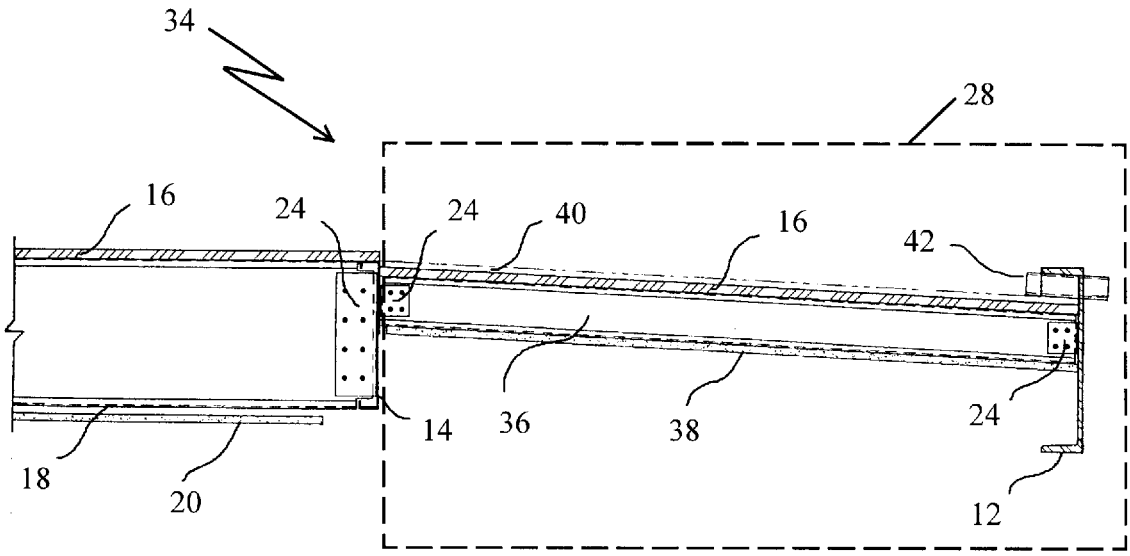
FIG. 8 illustrates the structural details of another section of the balcony of FIG. 6.

Sectional view 34 of balcony portion 28 is also identified on FIG. 6, wherein FIG. 8 illustrates the details and components of the floor/ceiling assembly 10 at sectional view 34. The materials and components in this sectional view 34 are similar to those described for sectional view 32. Yet in this detail, fasteners 24, for example, 16 ga clip fasteners 24, are used to attach the balcony joists 36 to both the interior joist 14 and the perimeter joist 12. Here also the balcony joists 36 are set so that there is a downward slope from the sides and back of the balcony to its center and front. A section of 1½" PVC pipe 42 can be inserted through an upper web portion of the perimeter joist 12 to drain water from the balcony.

Figure 9:
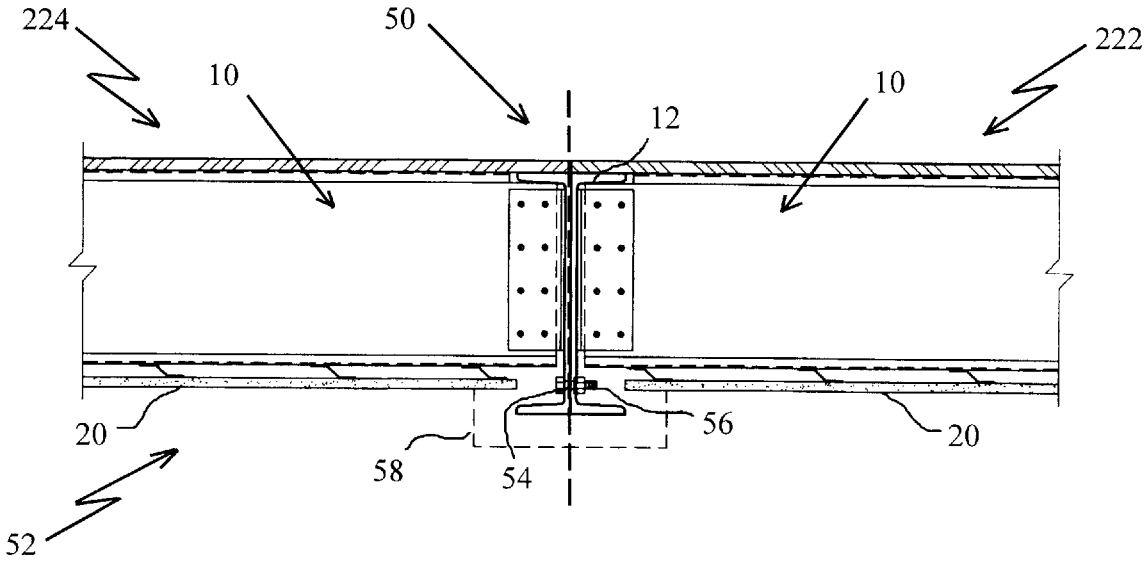
FIG. 9 illustrates the interconnection assembly of the present invention being a channel to channel connection of two floor/ceiling assemblies.

Interconnection system 50 of the floor/ceiling assemblies 10 enables the connection of units at the construction site, which interconnection assembly 50 does not inhibit the pre-finishing of the interior and exterior walls. FIG. 9 illustrates the interconnection system 50 comprising a horizontal connection between two floor/ceiling assemblies 10 that are part of two adjacent modules. An example of a location for the interconnection system 50 is shown as sectional view 52 in FIG. 6. Slots 54 can be 48" o.c. and are provided along the base of the webs on the perimeter joists 12 that are part of the floor/ceiling assemblies 10. When two modules are placed next to each other, the slots 54 are aligned and connected using, for example, ½" bolts 56 to connect the opposing channels. The recessed ceilings of the floor/ceiling assemblies 10 allow access to the slots for the bolt connections without penetrating the pre-finished ceiling. The areas around the bolts 56 and along the bottom flange of the perimeter joists 12 are subsequently finished on the site with gypsum ceiling 20, molding 58 and paint.

Among other advantages, the present floor/ceiling assembly 10 enables module connection systems to be employed other than that of traditional welding. The floor/ceiling assembly 10 overcomes the need to weld the modules together at the site. If the modules had to be welded to each other, the sparks and molten material generated from the welding process would extensively damage a considerable amount of the desired pre-finish on the interior and exterior wall surfaces. The design of floor/ceiling assembly 10 allows for inter-module connections at the site without the need for welding.

II. Load-Bearing Assembly

The present invention can further comprise a load-bearing assembly 60 to transfer a majority, if not all, of the loads from the roof of the top floor to the foundation of building 210. Each module preferably has a number of load-bearing assemblies 60 attached to the perimeter joists 12 at specifically engineered locations. When any upper floor module 218 is "stacked" on to any lower floor module 220, the weight of the upper floor module is supported by the load-bearing assemblies 60. The use of these load-bearing assemblies 60, or sometimes referred to as vertical support assemblies 60, opens up the possibilities for varying the design of the modules since few to none of the walls of any module, neither the interior walls nor the exterior walls, are secondarily, if at all, load-bearing. Since none of the walls bear significant loads, every wall can be uniformly constructed at the factory without concern about varying the sizes, groupings, and spacing of the studs. And because the load-bearing assemblies 60 are designed to fit within the wall cavities, virtually all of the interior and exterior surfaces of a module's walls can be pre-finished in the factory. This pre-finishing is further made possible because the vertical support assemblies 60 are connected vertically from one module to another without the need for welding. When the modules are also connected to the stabilization assembly 170 of the present invention, the load-bearing assemblies 60 enable modules to be stacked up to at least seven stories in height.

Figure 10:
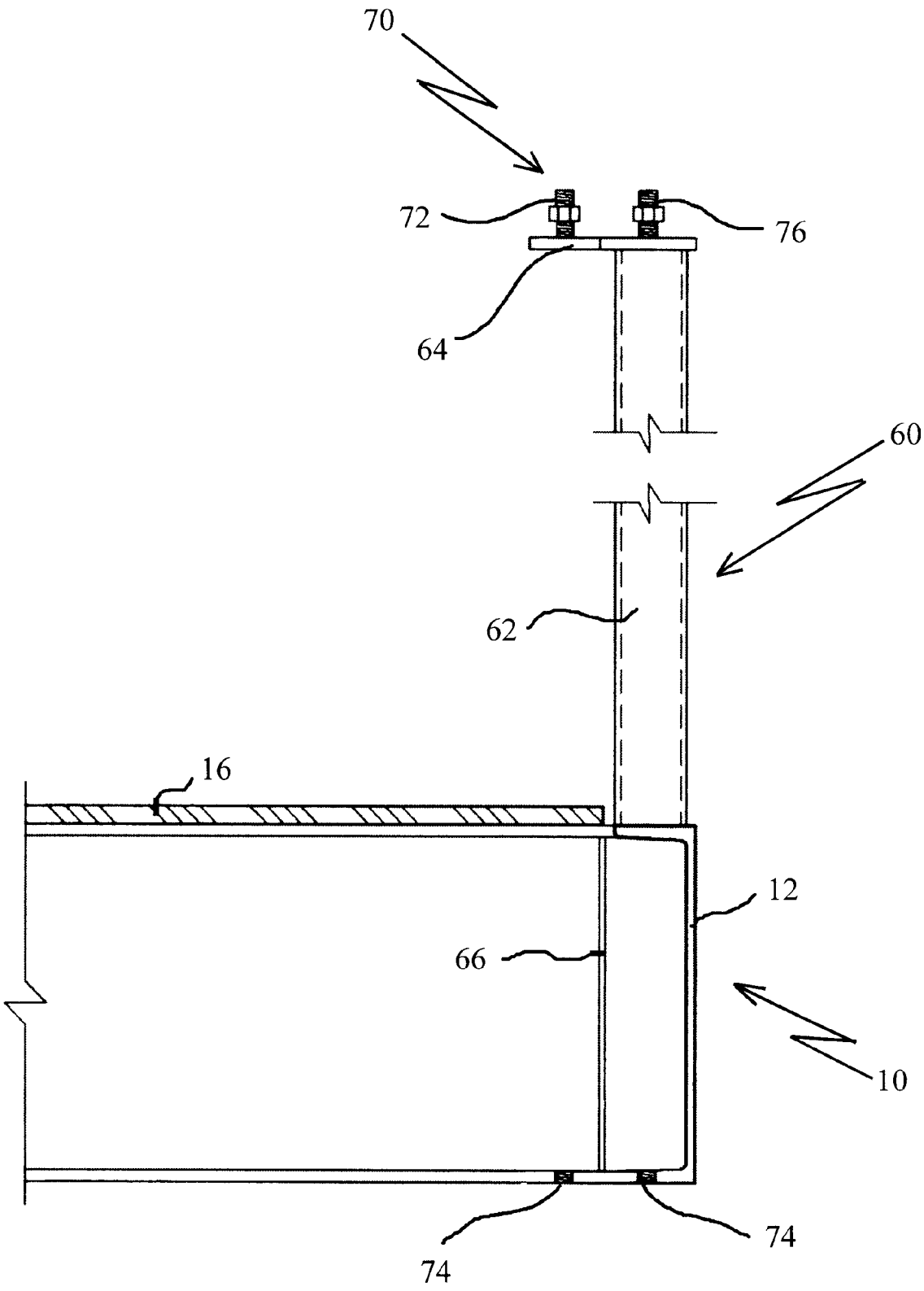
FIG. 10 illustrates the details of one embodiment of the load-bearing assembly of the present invention, and its attachment to the structural framing of the floor/ceiling assembly as part of one module.

The vertical support assembly 60 comprises vertical member 62, vertical member cap 64 and connection subassemblies 70, as shown in FIG. 10. Vertical member 62 can be a variety of geometries and strengths to carry the described load, as, for example, a 3×3×0.25 steel column 62. A column cap 64 of, for example, ¼" thick steel, can be welded to one end of a steel column 62. The connection subassemblies 70 can include ¾"×2" long threaded studs 72 that can be welded to cap 64, holes 74 bored into the bottom flange of perimeter joist 12, and nuts 76. At specific locations, the end of steel column 62 opposite the end having the cap 64 can be attached in the factory, for example by way of welding or the use of bolts, to the top flange of a perimeter joist 12 that is part of a floor/ceiling assembly 10. Where steel column 62 is attached to perimeter joist 12, web stiffeners 66 can be used and welded to the joist. The centers of holes 74 are positioned to match the locations of the centers of the threaded studs 72 that are part of the above load-bearing assembly 60.

Figure 11:
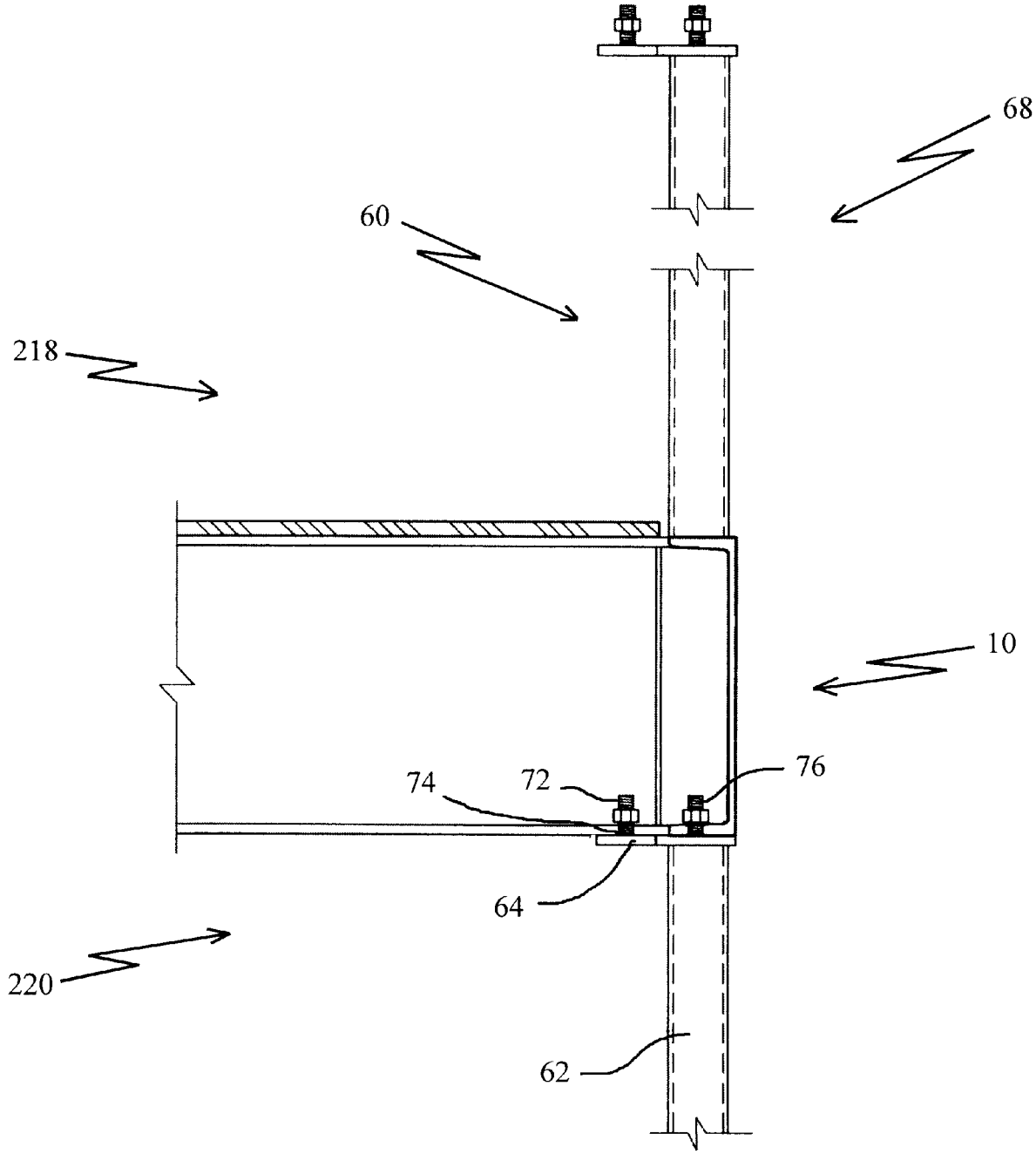
FIG. 11 illustrates the details of a load-bearing assembly that is part of a lower floor module, and its connection to the structural framing of the floor/ceiling assembly that is part of an upper floor module.

When an upper floor module 218 is to be stacked on to a lower floor module 220, the vertical support assemblies 60 from each of these modules align vertically. As illustrated in FIG. 11, when module 218 is set onto module 220, the threaded studs 72 that are part of a load-bearing assembly 60 on module 220 are inserted into the holes 74 that are part of floor/ceiling assembly 10 on module 218. Nuts 76 are then tightened onto the studs 72.

Figure 12:
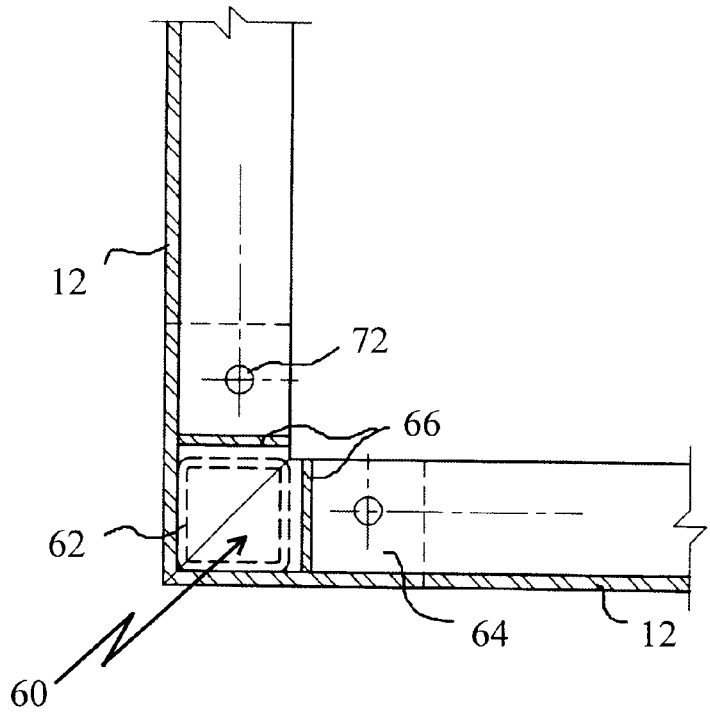
FIG. 12 illustrates a plan view of a load-bearing assembly that is attached to a corner of the structural framing of a floor/ceiling assembly.

FIG. 12 illustrates a plan view of vertical support assembly 60 where two perimeter joists 12 intersect at an exterior corner of a module. Shown are the relative positions of steel column 62 and web stiffeners 66. At this particular location, cap plate 64 is L-shaped, the exterior dimension of each leg of cap plate 64 being 6¾" with an interior dimension of 3⅝", and the plate being 3⅝" wide. The threaded studs 72 are centered 1½" from the ends of the legs and 1⅜" from the inside of the legs of cap plate 64.

Figure 13:
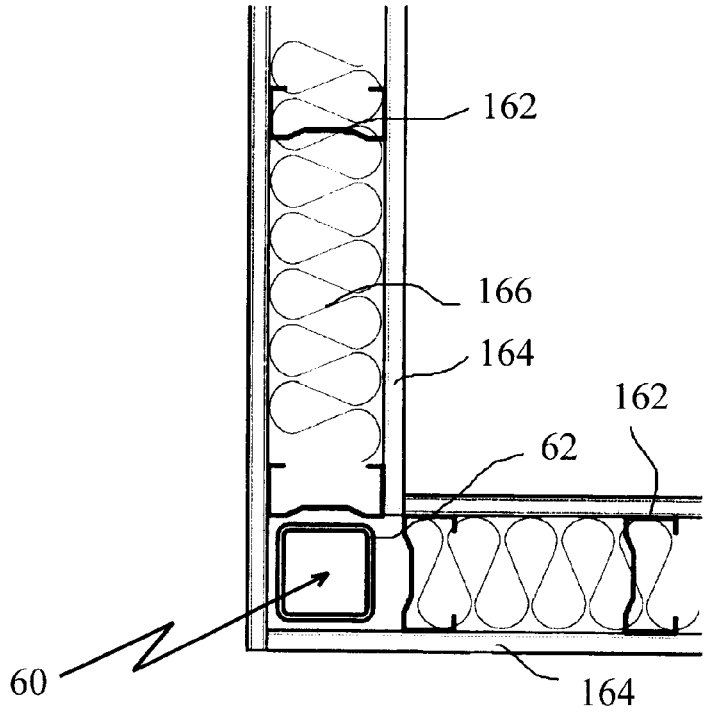
FIG. 13 illustrates a plan view of a columnar tube that is part of the load-bearing assembly from FIG. 12 in relation to adjacent pre-finished walls of a module.

As previously mentioned, the entire load-bearing assembly 60 can be encapsulated within the walls of a module as illustrated in FIG. 13. The exterior walls for building 210 are typically constructed using, for example, 3⅝"-20 ga metal studs 162, ⅝" type X gypsum wall sheathing 164, and 3½" batt insulation 166, among other materials. Shown is the steel column 62 positioned at an exterior corner of a module as detailed in FIG. 12. The wall sheathing 164 completely surrounds and hides the parts of vertical support assembly 60, including column 62. Thus all of the surfaces of the interior and exterior walls can be pre-finished in the factory.

Figure 14:
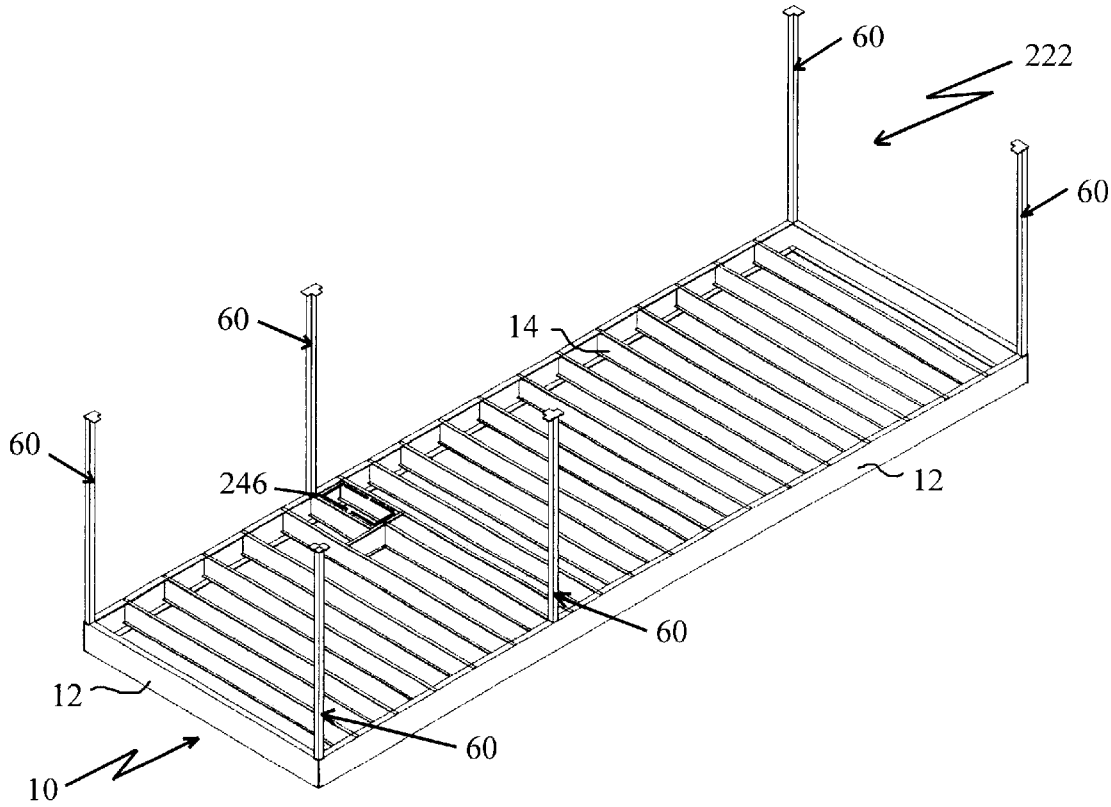
FIG. 14 illustrates load-bearing assemblies and the structural framing for the floor/ceiling assembly of a "wet" module.
Figure 15:
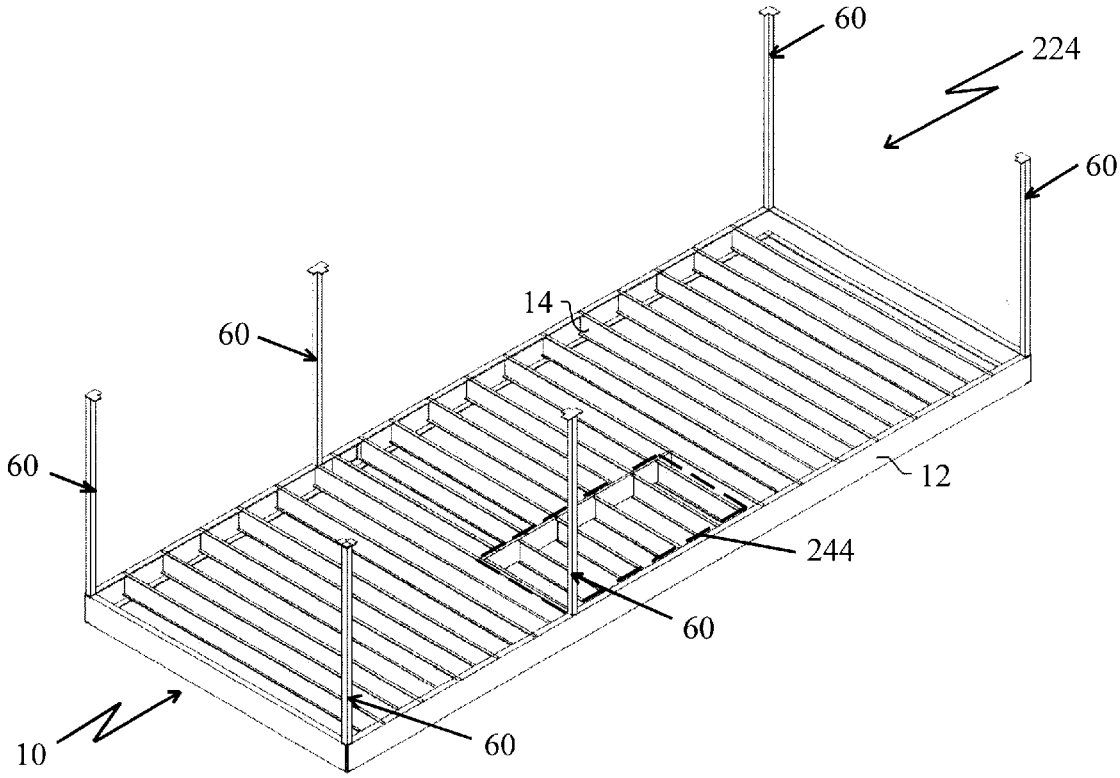
FIG. 15 illustrates the use of load-bearing assemblies and the structural framing of a floor/ceiling assembly of a "dry" module.

The one-bedroom apartment floor plan illustrated in FIG. 2 indicates locations for the load-bearing assemblies 60 for modules 222 and 224, according to one embodiment of the present system. FIGS. 14 and 15 isolate these vertical support assemblies 60 and the structural framing from the floor/ceiling assemblies 10 in perspective views for modules 222 and 224, respectively. Locations for the mechanical chase 246 and the balcony 244 also are shown.

Figure 16:
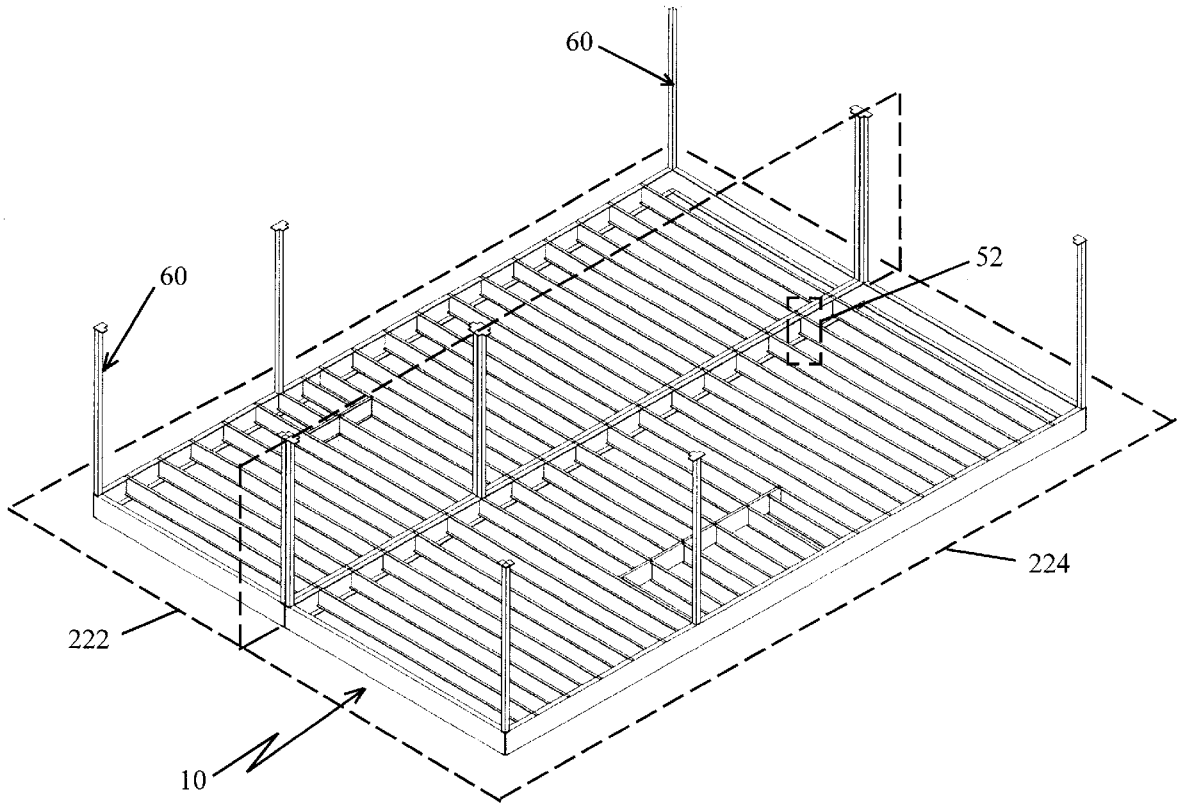
FIG. 16 illustrates the positioning of load-bearing assemblies and the structural framing of the floor/ceiling assemblies when modules are connected to each other at the site.
Figure 17:
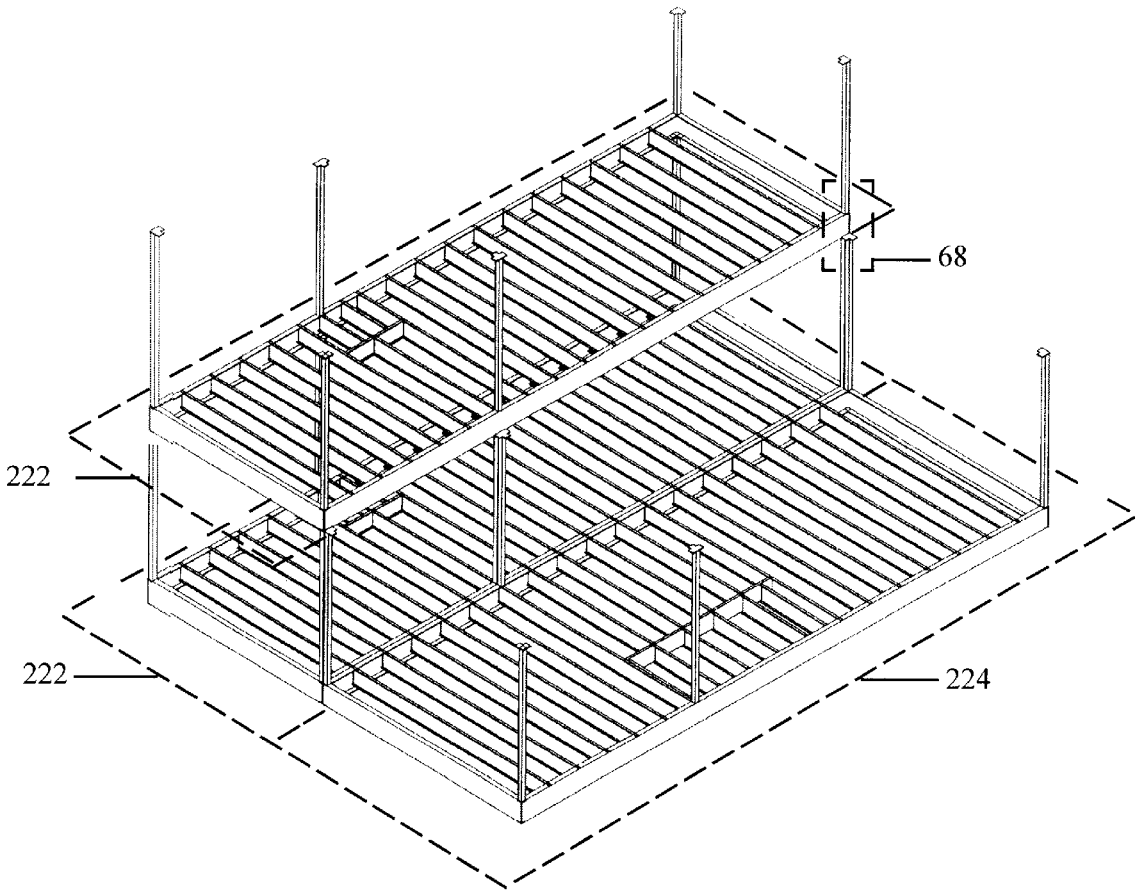
FIG. 17 illustrates the positioning of load-bearing assemblies and the structural framing of the floor/ceiling assemblies when a module for an upper floor unit is placed onto a module that is part of a lower floor unit.

FIG. 16 provides a perspective view of the relative positions of the assemblies from FIGS. 14 and 15 when module 224 is attached to module 222. The typical channel to channel location of the interconnection system 50 (sectional view 52) between two floor/ceiling assemblies 10 is illustrated in FIG. 9. FIG. 17 illustrates the relative positions of the assemblies when a module 222 is "stacked" onto a module 222 from FIG. 14 that is already in place. Sectional view 68 indicates the location of the connection between a load-bearing assembly 60 and a floor/ceiling assembly 10 illustrated in detail in FIG. 11.

Figure 18:
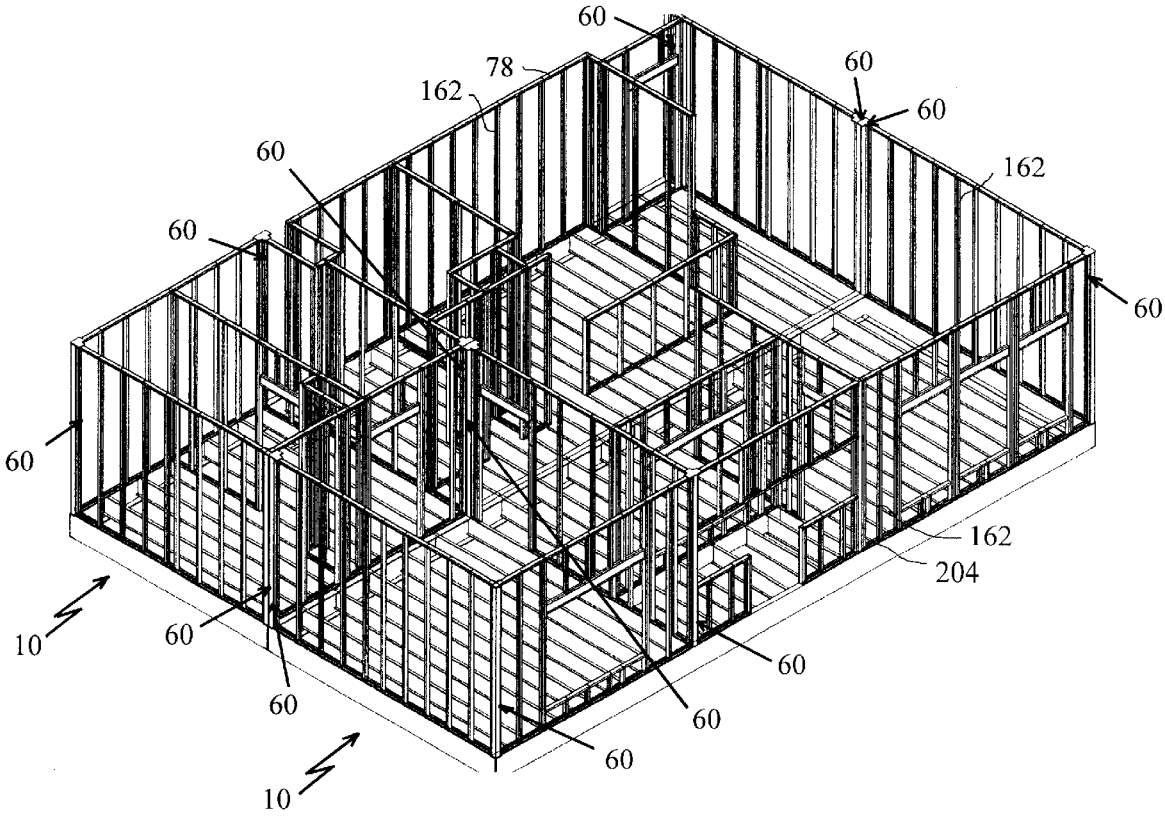
FIG. 18 illustrates the framing of the interior and exterior walls of modules with relation to the load-bearing assemblies and the structural framing of the floor/ceiling assemblies.

FIG. 18 illustrates the framing of the interior and exterior walls of modules 222 and 224 with relation to the vertical support assemblies 60 and the structural framing of the floor/ceiling assemblies 10 as shown in FIG. 16. The wall framing of FIG. 18 further illustrates top tracks 78, bottom tracks 204 and studs 162 of the metal wall framing. Note that all of the assemblies and walls are actually enclosed as part of the pre-finished modules when brought to the site from the factory.

III. Temporary Lifting-Transportation Roof Assembly

The present invention can further comprise a temporary roof assembly 80 incorporating perimeter members 82 in combination with a plurality of interior members 84, and a roof 86.

As previously mentioned, with typical modular construction there is a substantial duplication of materials by having a separate floor and ceiling for each module. The elimination of this duplication has been achieved in part by using the floor/ceiling assembly 10. Yet, without the attachment of the separate ceiling, a need arises to protect the pre-finished module from the elements during transit from the factory to the site, and during the erection stage wherein the modules are lifted into position in the building 210.

One of the functions of the present temporary roof assembly 80 is to temporarily cover and protect the pre-finished module. The temporary roof assembly 80 further beneficially limits construction site material waste. After the roof assembly 80 has been used as a temporary protection for a module being transported and removal from the module at the site, the entire temporary roof assembly 80 can be shipped back to the factory for reuse on another module.

Figure 19:
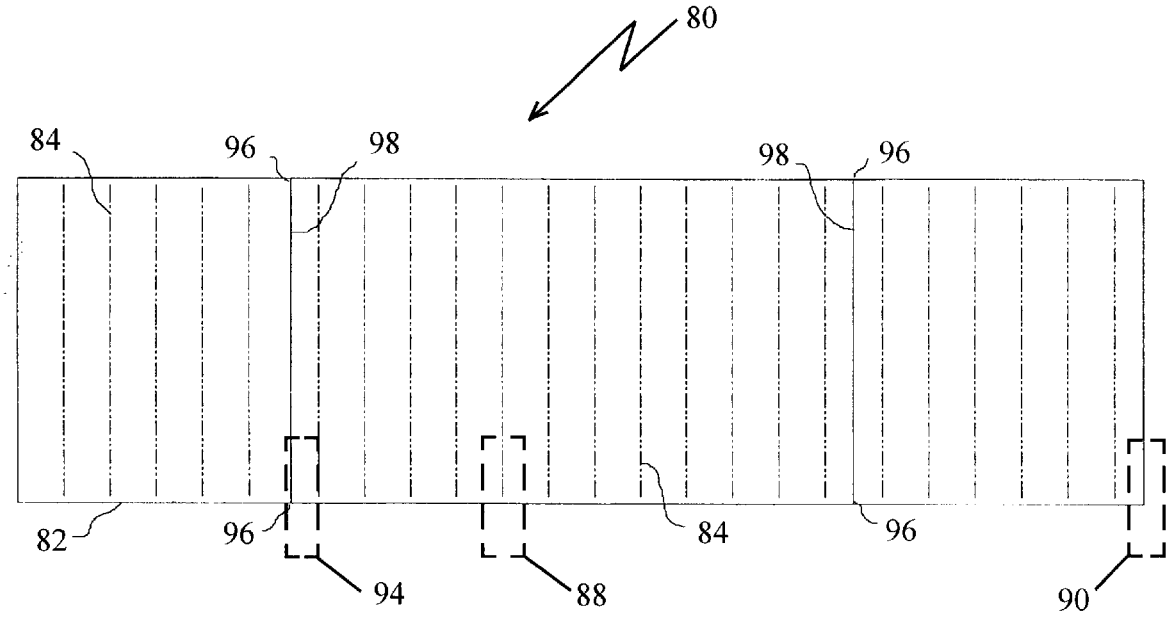
FIG. 19 illustrates a plan view of the structural components of a temporary lifting-transportation roof assembly according to a preferred embodiment of the present invention.

The temporary lifting-transportation roof assembly 80 somewhat structurally resembles the present floor/ceiling assembly 10. FIG. 19 illustrates a plan view of the temporary roof assembly 80, wherein the outside dimensions of the assembly 80 are similar if not identical to those of the floor/ceiling assembly 10 on the module that is to be covered. Perimeter joists 82 can be C10×15.3 steel structural channels, and the interior joists 84 can be 6"–18 ga steel channels set at 2'–0" o.c. Roof deck 86 shown in FIG. 20 preferably covers the steel frame, and the temporary unit can be made watertight by fastening on to temporary assembly 80 the same generic membrane roof 214 that is used for the permanent surface of the roof on building 210, shown in FIG. 1.

Figure 20:
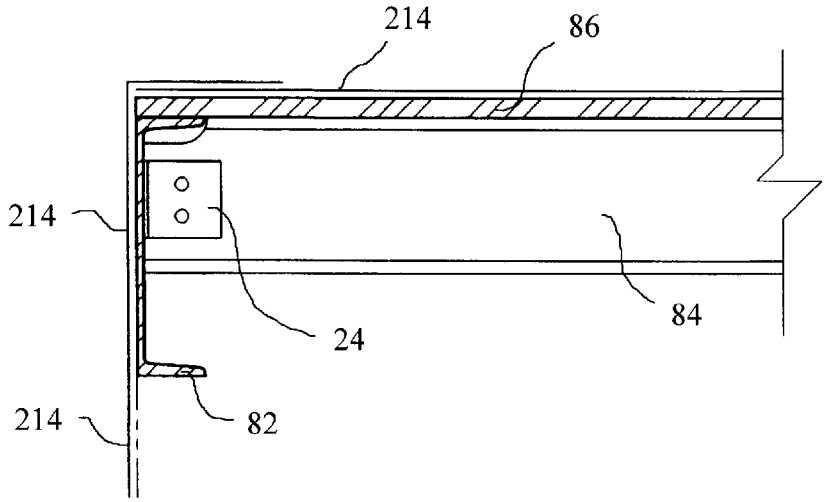
FIG. 20 illustrates a section of a temporary lifting-transportation roof assembly where an interior joist is attached to a perimeter joist.

FIG. 20 illustrates details of the sectional view 88 (see FIG. 19) of temporary assembly 80 , where an interior joist 84 is attached to a perimeter joist 82 using 16 ga clip fasteners 24. As with the floor/ceiling assembly 10, the flange of interior joist 84 is coped so that the top of the flange is at the same plane as the top of the flange on perimeter joist 82. Preferably, the waterproofing membrane 214 extends six inches below the point where the membrane 214 is fastened to the bottom of the face of perimeter joist 82. This six inch extension provides a temporary covering over the exposed joint where the top of the module meets the temporary roof assembly 80.

A method of attaching the temporary lifting-transportation roof assembly 80 to the pre-finished module contributes to a second function of the temporary roof assembly 80. The temporary roof assembly 80 is attached directly to the load-bearing assemblies 60 of the pre-finished module. This temporary attachment thus adds strength and rigidity to the pre-finished module during transit from the factory to the erection site. This temporary assembly 80 further assures the continued stability of the vertical support assemblies 60 because the spacing between the attachment points of the temporary roof assembly 80 is similar, if not identical, to the spacing between the attachment points of the module that is to be set upon this current module.

Figure 21:
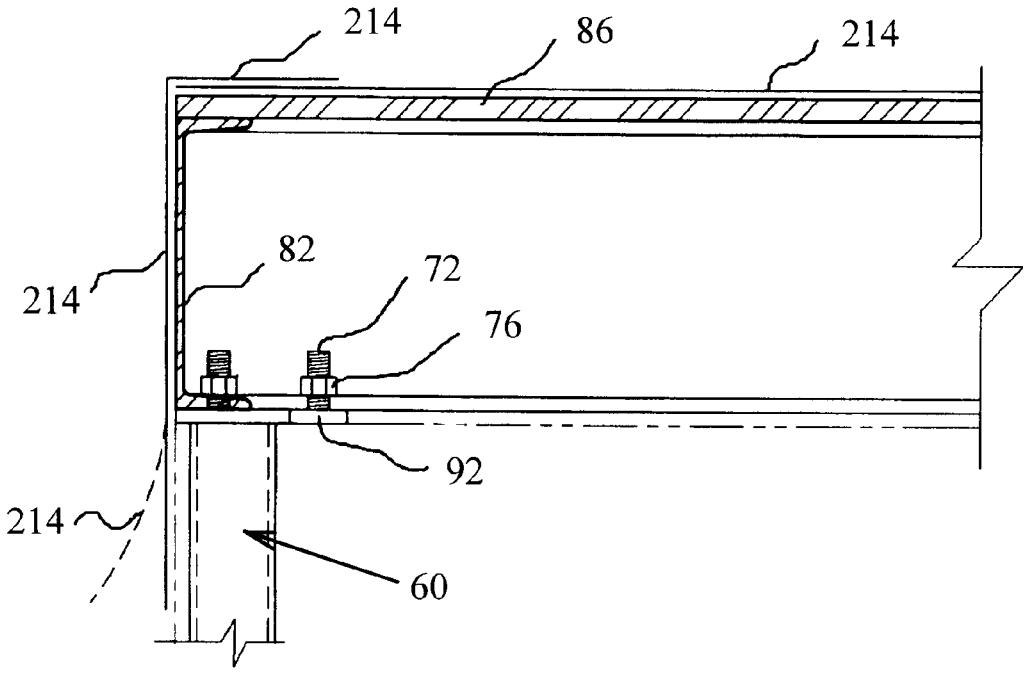
FIG. 21 illustrates a section of a temporary lifting-transportation roof assembly where it is attached to a load-bearing assembly that is part of a pre-finished module.

FIG. 21 illustrates details of the sectional view 90 (see FIG. 19) of the temporary roof assembly 80 where it is attached to a load-bearing assembly 60. One way to attach the temporary roof assembly 80 with the vertical support assembly 60 is to bore slots 92 into the bottom flange of the perimeter channel 82. These holes 92 match the same location of the holes 74 that were previously bored into the perimeter channel 12 that is part of the floor/ceiling assembly 10 on which the illustrated load-bearing assembly 60 has been attached (see FIG. 11). When the temporary roof assembly 80 is placed upon the pre-finished module, the threaded studs 72 that are part of vertical support assembly 60 are inserted into the holes 92. Nuts 76 are then only finger-tightened onto the studs 72.

Yet a third function of the temporary lifting-transportation roof assembly 80 is to provide a method by which the pre-finished module can be lifted by a crane and placed onto the stabilization assembly 170 at the construction site. The lifting feature of the temporary roof assembly 80 can also be used within the factory when the module has to be raised or moved as part of the assembly and pre-finishing process.

Figure 22:
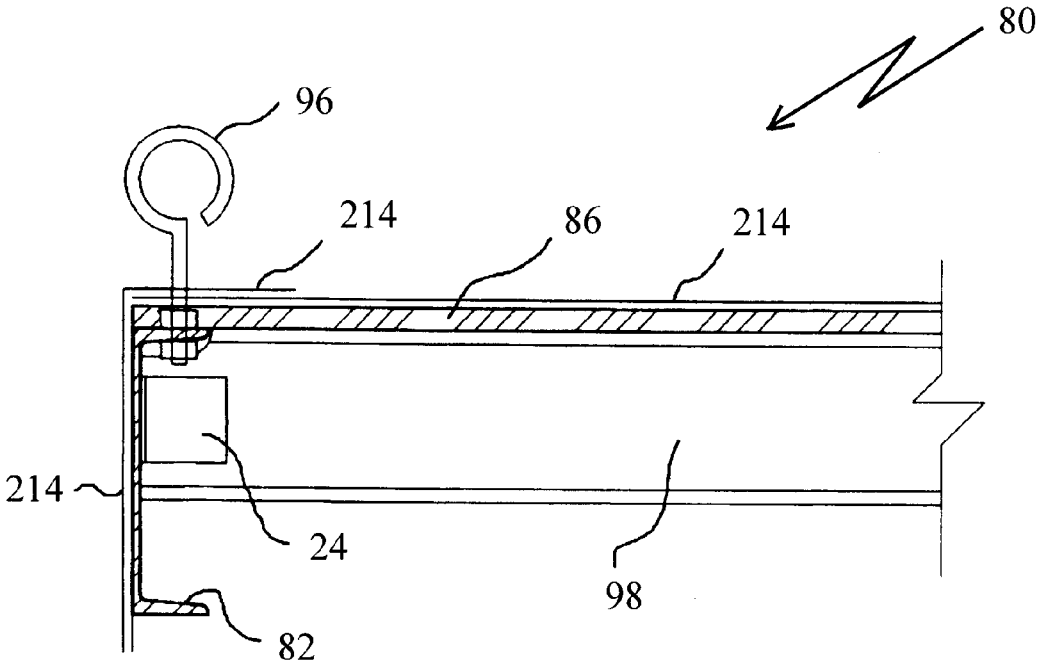
FIG. 22 illustrates a section of a temporary lifting-transportation roof assembly having an eyebolt attached.

FIG. 22 illustrates details of the sectional view 94 (see FIG. 19) of the temporary lifting-transportation roof assembly 80 at the location of an eyebolt 96. A steel channel 98 is attached to perimeter joist 82 with a welded 4×4×¼×0'–6" clip 24. The eyebolt 96 is bolted rather than welded to the perimeter joist 82. This allows for the removal of the eyebolt so that the temporary roof assemblies 80 can be stacked upon each other for transport back to the factory. In a preferred embodiment, four ¾" eyebolts 96 with 3" inside diameters are bolted to the top flange of a perimeter joist 82, two on each side of the temporary roof assembly 80. The specific locations of these eyebolts 96 along the perimeter joists 82 are based on the weight distribution required to lift the module while keeping it level. As shown in FIG. 19, two C6×8.2 structural steel channels 98 can be substituted for the interior channels 84 between the locations of two opposite lift points.

Figure 23:
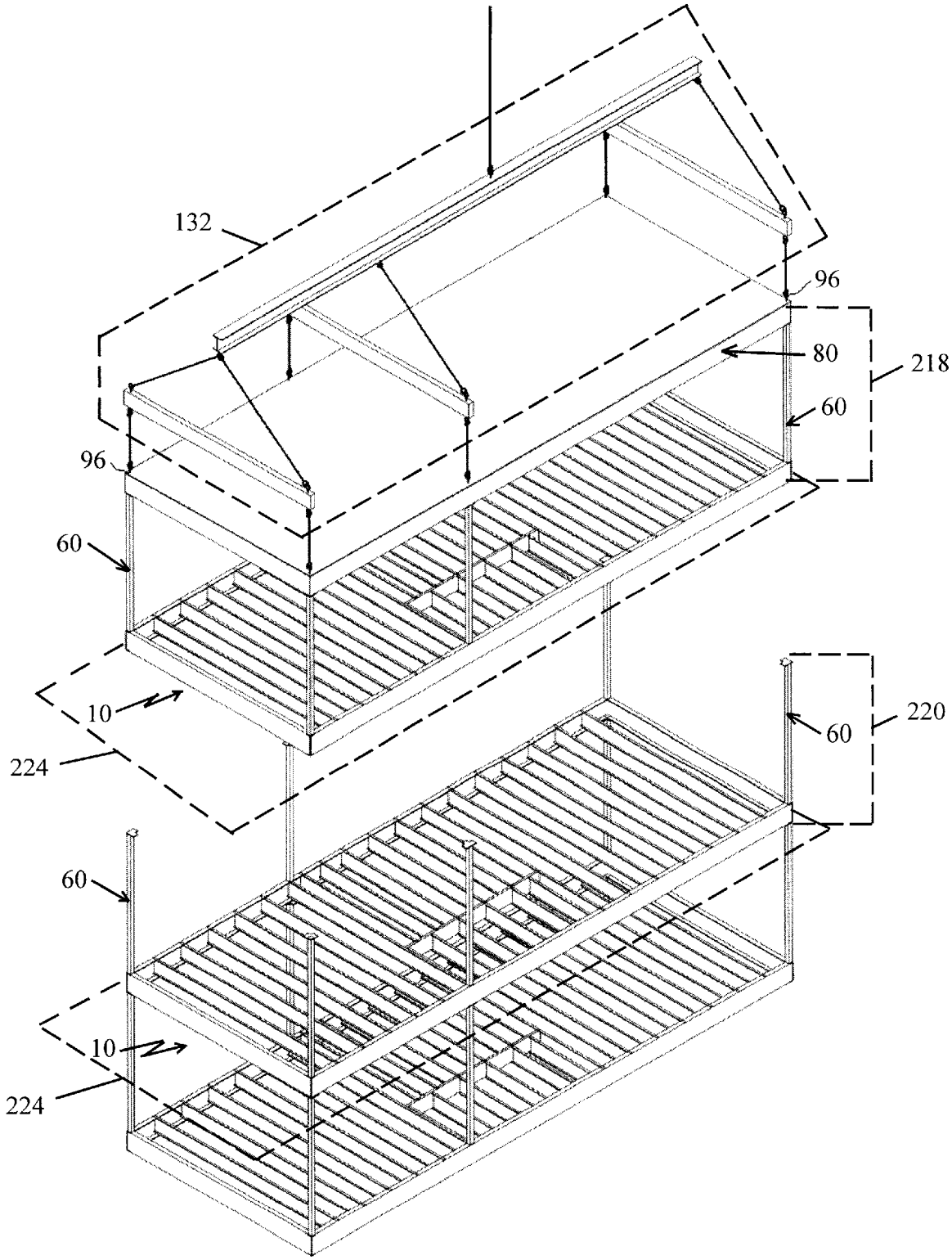
FIG. 23 illustrates the use of a temporary lifting-transportation roof assembly during the placement of an upper module onto a lower module.

FIG. 23 illustrates a temporary lifting-transportation roof assembly 80 that is being used to lift a module 224 at the site. This upper module unit 218 is being placed on a lower module unit 220. Module 220 had been shipped from the factory to the site with a temporary roof attached. It was removed when upper module 218 was ready to be placed on top of module 220. The upper module unit 218 will be set onto module 220 so that the threaded studs 72 (not shown) that are part of the load-bearing assemblies 60 on module 220 can be inserted into holes 74 (not shown) that are located on the bottom flange of the perimeter joists 12 of module 218 (see FIG. 11). A lifting frame 132 that is hung from a crane (not shown) can come in different shapes and sizes as determined by contractors familiar with this state of the art. Lines (chains, metal straps, etc.) from the lifting frame are attached to the eyebolts 96 on the temporary roof assembly 80. Note that modules 224 will actually be delivered to the site in a pre-finished condition. It will be understood that FIG. 23 shows only structural members to better illustrate the inter-relationships of the various assemblies.

IV. Permanent Roof Assembly

The temporary lifting-transportation roof assembly 80 can be used on all of the modules that make up the apartments in building 210. The permanent roof assembly 140 of FIG. 24 preferably is attached in the factory to top floor modules, but need not be as the permanent roof assembly 140 can be shipped to the construction site and then arranged on a module. This permanent roof assembly 140 has some of the same functions as the temporary roof assembly 80; it covers and protects the pre-finished module, it adds rigidity and strength to the module, and it serves as a lifting platform during erection at the site. The difference is that this roof assembly is made to stay permanently in place as part of building 210. The generic roof membrane system 214 is attached to each module. The open gaps between the roof membranes on each module are sealed at the site. Individual manufacturers specify the methods for sealing their product, but typically the sealing occurs by heat welding together overlapping membrane flaps. The structural framing for the individual permanent roof assemblies 140 is sloped to provide drainage for water. The use of the permanent roof assemblies 140 with the protective roofing material 214 already attached once again eliminates a tremendous amount of site work compared to the typical stick-built construction.

Figure 24:
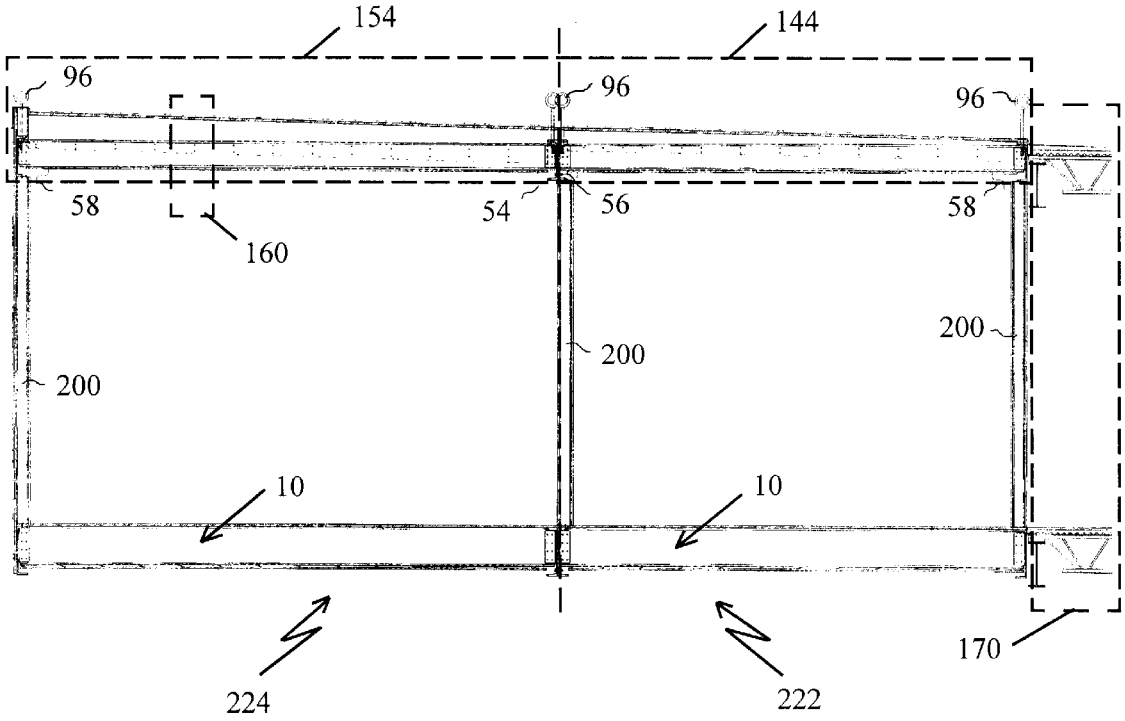
FIG. 24 illustrates a section of pre-finished permanent roof assemblies that are attached to separate top-floor modules in the factory.

FIG. 24 illustrates a section of two top floor modules 222 and 224 that have been set in place against stabilization assembly 170. The permanent roof assemblies 140 have been attached to the vertical support assemblies 60 in the plant by inserting the threaded studs 72 into the holes 74 that have been bored into the perimeter joists 142. The eyebolts 96 will be removed and the residual holes will be sealed. Since building 210 eliminates its roof rainwater through interior drains that are part of stabilization assembly 170, a consistent slope from the front face of building 210 to the center core must be maintained.

Figure 25:
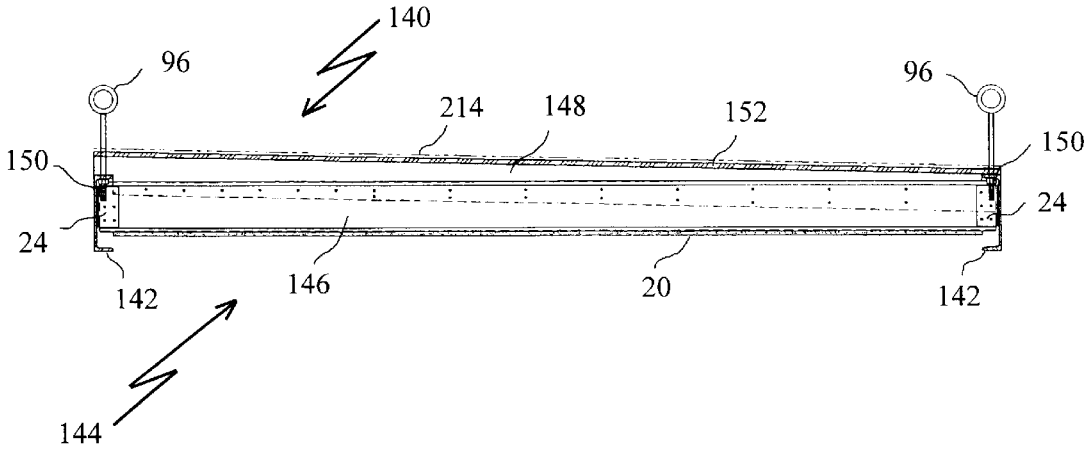
FIG. 25 illustrates sectional details of a pre-finished permanent roof assembly for a top-floor module.
Figure 27:
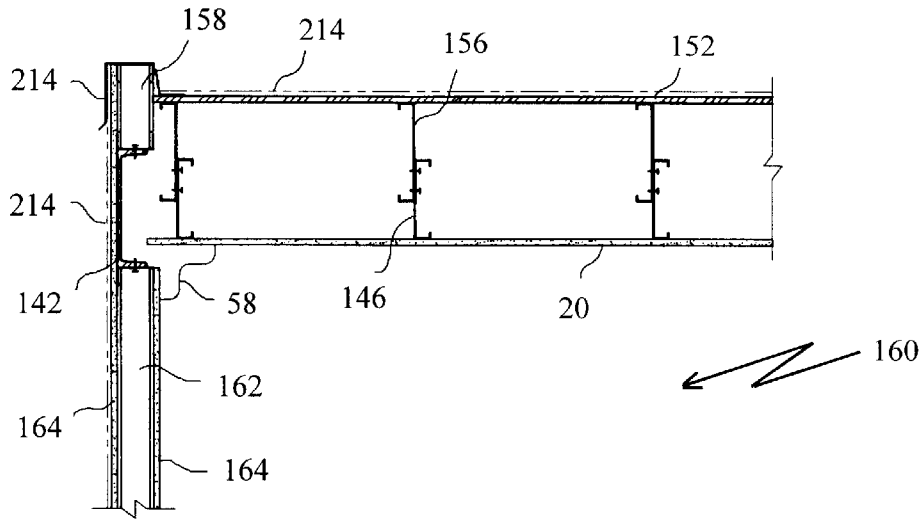
FIG. 27 illustrates sectional details of the structural components of a pre-finished roof assembly for a top-floor module.

FIG. 25 illustrates details of the sectional view 144 (see FIG. 24) of the permanent roof assembly 140 that is attached to top floor module 222. The construction of permanent roof assembly 140 in sectional view 144 is similar to floor/ceiling assembly 10. In this case, the perimeter joists 142 are C12×20.7 structural channels. Each of the interior roof/ceiling joists is made from two channels attached back-to-back as illustrated in FIG. 27. Each interior roof/ceiling joist pairs an 8"–16 ga channel 146 with a 6"–16 ga channel 148. Interior joists 146 are attached as horizontal members to perimeter joists 142 with clip fasteners 24. Gypsum sheathing 164 is attached directly to the bottom flange of interior joists 146; the ceiling is subsequently pre-finished. Interior joists 148 are screwed to each joist 146 to provide a slope of ¼" in 12". As with the temporary roof assembly 80, four holes are bored into the top flanges on the perimeter joists 142 to accept the lifting bolts 96. Nuts 150 are welded to the underside of the top flanges. After the module 222 has been attached to stabilization assembly 170 and the other contiguous modules, the lifting bolts 96 will be unscrewed and removed. A plywood deck 152 is attached to the top flanges of interior joists 148. The roof membrane 214 is then attached to the roof deck 152. After the bolts 96 are removed, the four holes in the roof membrane 214 are plugged as specified by the roofing manufacturer.

Figure 26:
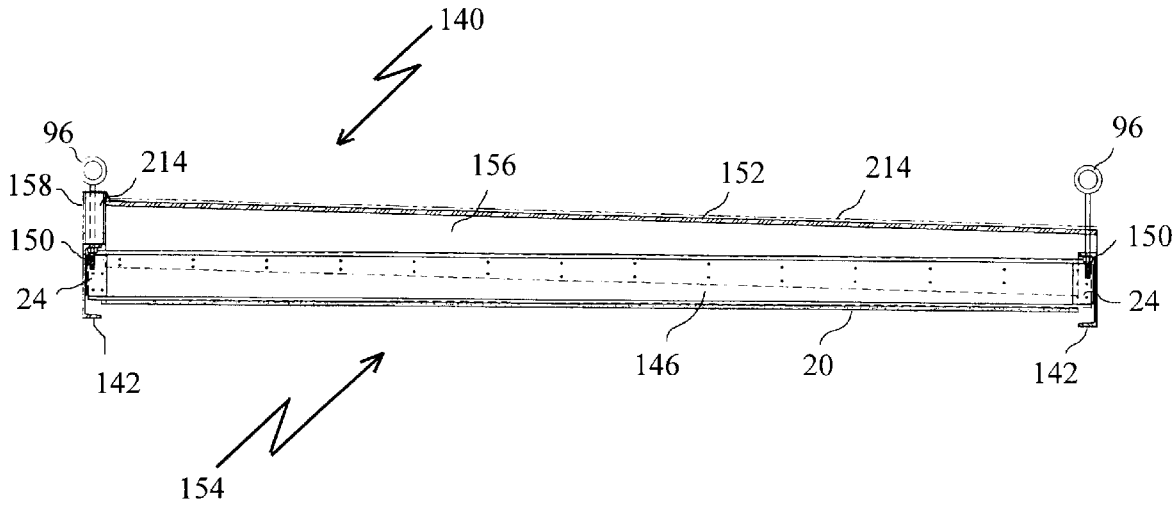
FIG. 26 illustrates sectional details of a pre-finished permanent roof assembly for a top-floor module.

FIG. 26 illustrates details of the sectional view 154 (see FIG. 24) of the permanent roof assembly 140 that is attached to top floor module 224. The construction of permanent roof assembly 140 in sectional view 154 is similar to the construction of sectional view 144 as described with reference to FIG. 25. Since the slope of the roof from module 222 continues upward on module 224, 10"–16 ga channels 156 are substituted in sectional view 154 for the 6"–16 ga channels 148 that are used in sectional view 144. The roof/ceiling joists 156 are attached to joists 146 so that a continuous roof pitch of ¼" in 12" is maintained across both sections of modules 222 and 224 (refer to FIG. 24). The outer ends of joists 156 are terminated at curtain wall 158. Made from metal studs 162 (FIG. 27) that are sheathed with roof deck 152, this 8" high curtain wall 158 is attached to the top flange of perimeter joist 142. The roof membrane 214 extends over and around the curtain wall sealing the stucco finish 212 in accordance with the manufacturers' specifications.

FIG. 27 illustrates details of the sectional view 160 (see FIG. 24) of the connection of joist 156 to joist 146. Pre-finished details are likewise identified. Sectional view 160 illustrates the continuation of curtain wall 158 along an exterior wall of module 224. As shown in FIG. 27, pre-finished roof membrane 214 extends down to and seals pre-finished stucco 212 in accordance with details provided by the respective material manufacturers.

V. Stabilization Assembly

The stabilization assembly 170 is yet another aid in the ease and efficiency of the construction of building 210. Referring back to FIG. 3, and shown in perspective view in FIG. 28, the corridors 172, corridor landings 174, and stairs 176 erected prior to the delivery of the pre-finished modules to the site enable the stabilization assembly 170 to provide a stable base to which the modules can be attached. Workmen have platforms from which to maneuver the setting of the modules and the interconnection of the modules, and utilities can be immediately staged for a quick completion.

Figure 29:
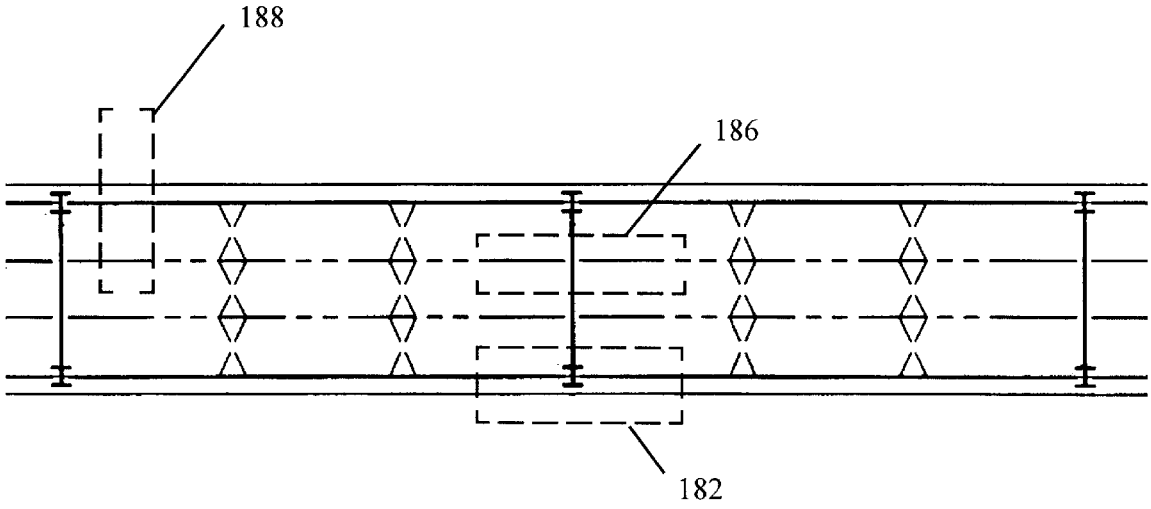
FIG. 29 illustrates the structural details in a plan view of a corridor that is part of stabilization assembly as shown on the building floor plan in FIG. 3.

The design of the foundations and the layout of the structural steel of the stabilization assembly 170 will vary based on the site, size of building, etc. These variations include the sizes and locations of the steel components that are engineered for the stresses anticipated at each location. However, there are several details of the stabilization assembly 170 that facilitate its use with modules. FIG. 29 illustrates a plan view of the typical corridor framing that is part of the building 210. To minimize the number of beams that are exposed in the finished corridor 172, a moment-resistant framework is used for the support structure. The horizontal members 180 of the moment resistant framework (sectional view 182 in FIG. 30) are hidden from view by a corridor ceiling that is finished after the modules have been set. The attachment of open-web steel joists 184 to the beam frames 180 (sectional view 186 in FIG. 31) provides the additional structural support required for the concrete corridor floors that are pre-finished prior to the arrival of the modules. Each of the modules 222 is attached to the framework of stabilization assembly 170 as shown in sectional view 188 in FIG. 32.

Figure 30:
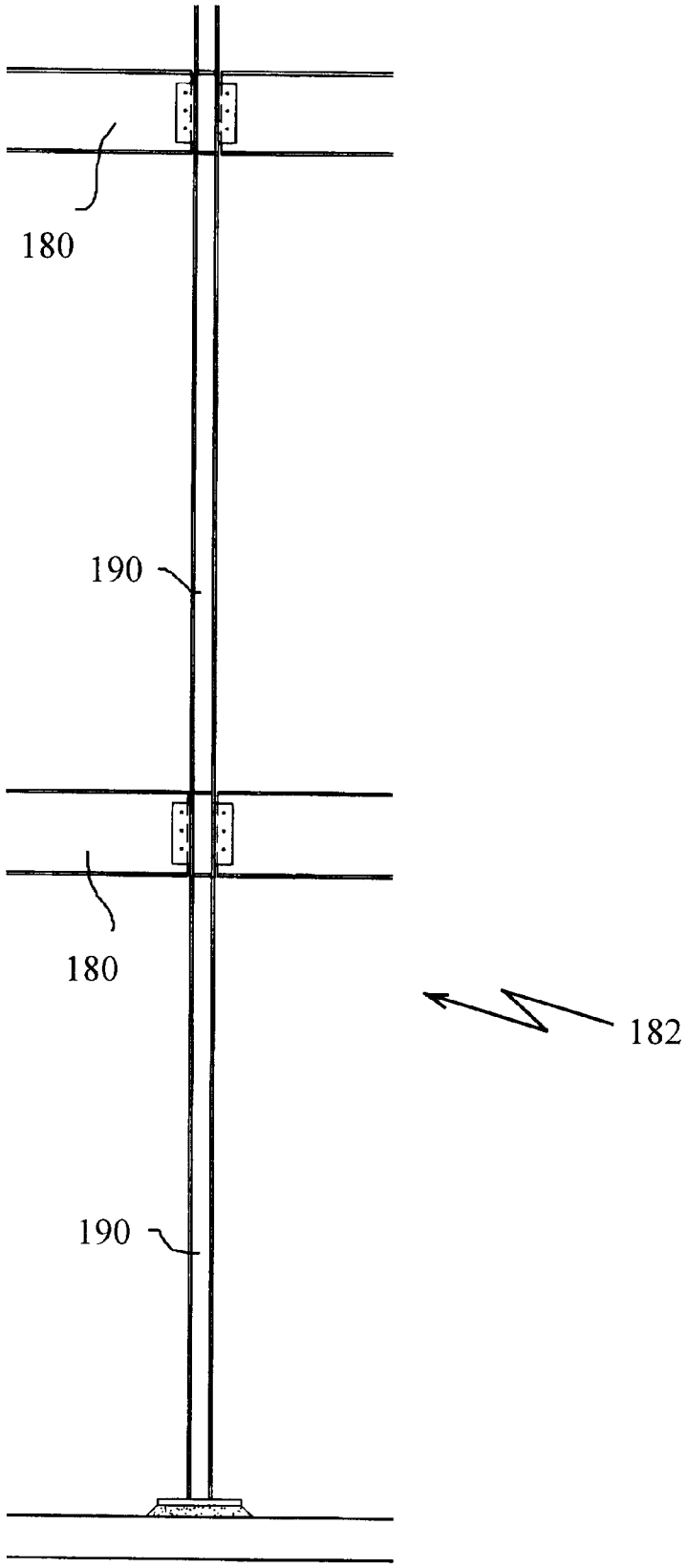
FIG. 30 illustrates structural components for the moment-resistant framing that is part of stabilization assembly.

The moment-resistant framework detail is illustrated in FIG. 30. Preferably, W8×24 beams are used for columns 190 and W10×12 beams are used for the horizontal support members 180. Beam to column flange connections and beam to column web connections are made using techniques familiar to those in this field of construction.

Figure 32:
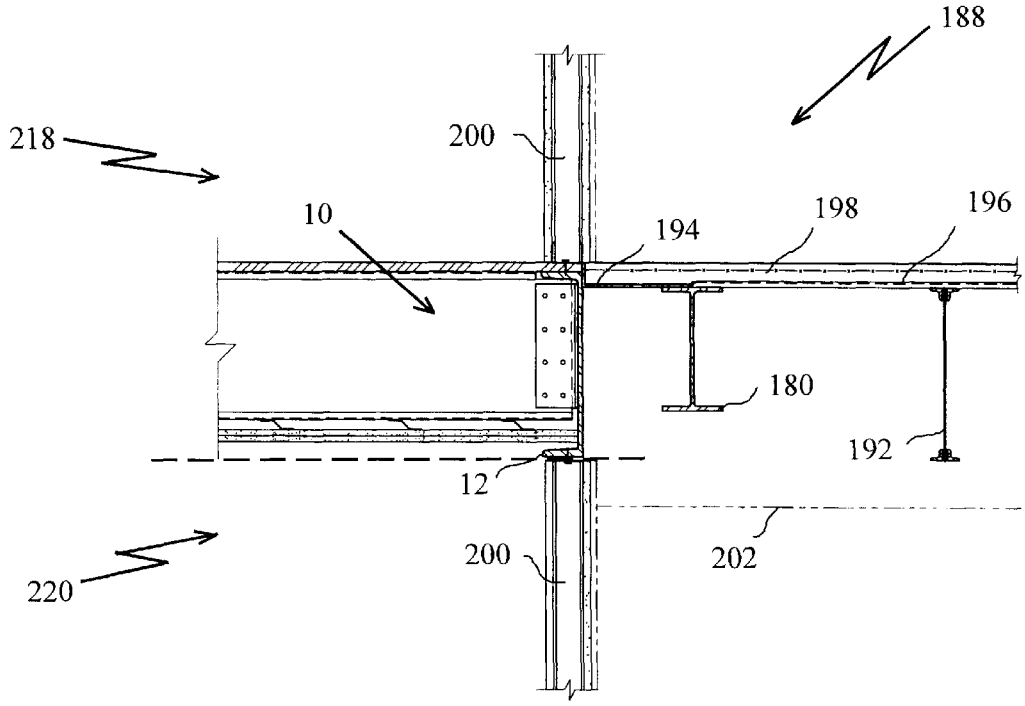
FIG. 32 illustrates the attachment of a module to a stabilization assembly.

FIG. 32 illustrates sectional details where two modules 222 are attached to the stabilization assembly 170 at the location identified by sectional view 188 in FIG. 29. At this section, a W10×12 beam 180 and an open-web 14K3 joist 192 are shown running lengthwise along the corridor. A 9×2×⅜" steel angle 194 is welded to the outside half of the top flange of beam 180. 9/16" permanent metal form 196 spans between two parallel beams 180. The metal form 196 and the angel 194 form a 2" pan into which concrete 198 is poured. After reinforcing, the concrete 198 becomes the floor of corridor 172. All of this occurs before the modules are shipped from the factory.

In sectional view 188 of FIG. 32, module 220 has already been set in place. The corridor pre-finished wall 200 that is part of module 220 is shown. Module 218, with its pre-finished floor/ceiling assembly 10 and its corridor pre-finished wall 200, is then attached to module 220 making use of the load-bearing assemblies 60 (not shown). Perimeter joist 12 that is part of floor/ceiling assembly 10 is then welded to angle 194. Site trim is then completed which includes the attachment of the corridor ceiling 202.

Figure 31:
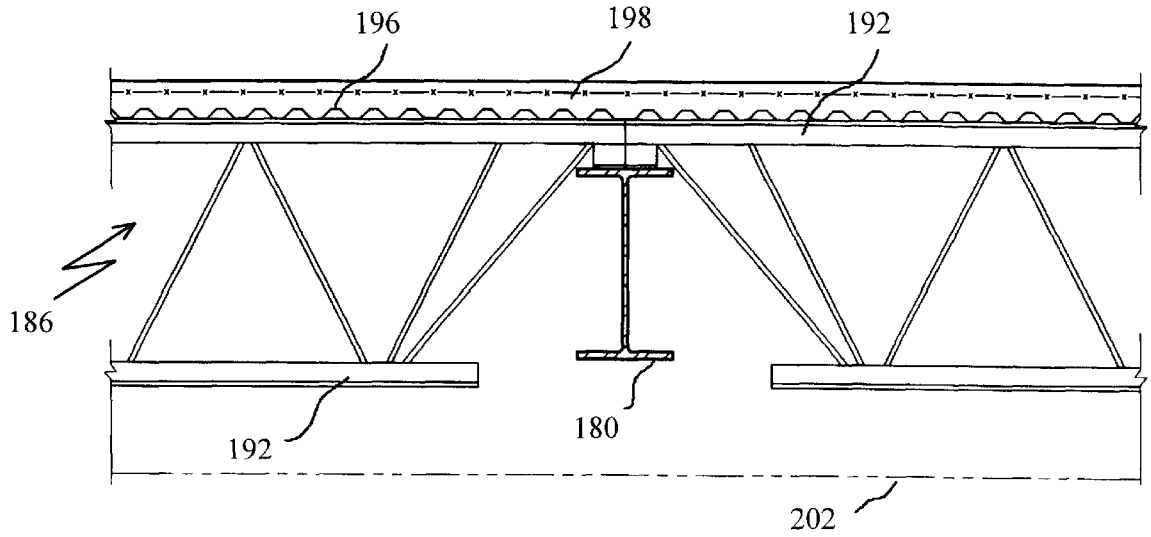
FIG. 31 illustrates sectional details of a floor/ceiling assembly for a corridor.

Open-web 14K3 steel joists 192 are used to span between the beams that make up the framework of the stability assembly 170 as illustrated in FIG. 31. In sectional view 186 in FIG. 31, the open-web joists 192 are attached to a W10×12 beam 180. Reinforced 2" concrete 198 covers 9/16" permanent metal forms 196 that are attached to the top chord of the open-web joists 192. The finished ceiling 202 is shown below the corridor framing.

VI. Pre-Finishing Modules

Figure 33:
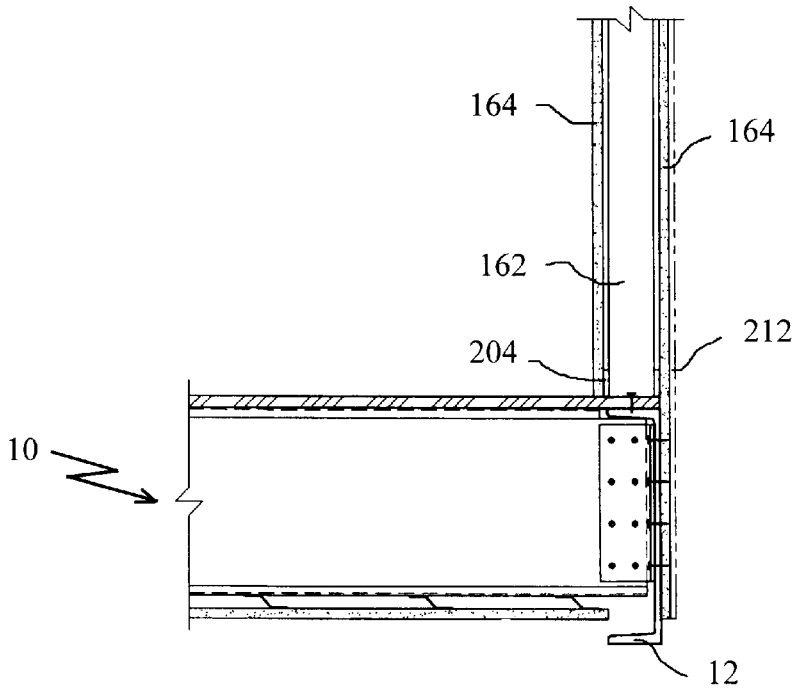
FIG. 33 illustrates sectional details where a pre-finished exterior wall is attached to a floor/ceiling assembly.

FIG. 33 is a section illustrating the attachment in the factory of an exterior wall of a module to a pre-finished floor/ceiling assembly 10 (as detailed in FIG. 4). The wall is framed using 3⅝"-20 ga metal studs 162 16" o.c. The bottom track 204 of the metal wall framing is screwed to the floor 16 that is part of the pre-finished floor/ceiling assembly. The interior surface of this wall is covered with ⅝" type X gypsum 164 (see FIG. 13) that is glued and screwed to the wall framing. After the interior gypsum 164 is finished, paint, wallpaper, or paneling is applied over the gypsum at the factory. The exterior surface of this wall also is covered with ⅝" type X gypsum 164 or the like. After the exterior gypsum is finished, the generic stucco system 212 is applied over the gypsum and pre-finished in the factory. Note that the exterior gypsum and stucco are extended to cover the face of the of the perimeter joist 12 that is part of the floor/ceiling assembly 10. Not shown in this illustration are the insulation, wiring, windows, etc. that are parts of the pre-finished exterior walls.

Figure 34:
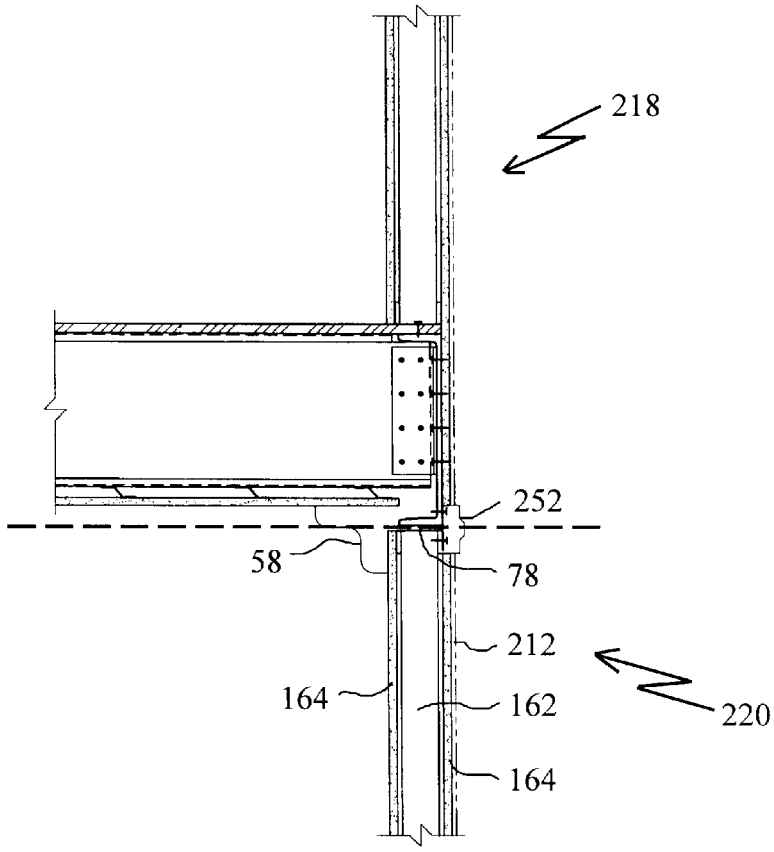
FIG. 34 illustrates sectional details where a pre-finished exterior wall of lower floor module is attached to the floor/ceiling assembly of a pre-finished upper floor module.

FIG. 34 illustrates a vertical connection between an upper module 218 and a lower module 220 at a section where there is no vertical support assembly 60. The pre-finished floor/ceiling assembly and exterior wall as detailed in FIG. 33 that are a pre-finished section of module 218 are shown after having been placed over the exterior wall that is a pre-finished section of module 220. The height of the pre-finished wall is ⅜" shorter than the top of the cap plate 64 on the load-bearing assembly 60. Accordingly, when the bottom flange of perimeter joist 12 is set on top of cap plate 64 (see FIG. 11), the ⅜"+/−gap occurs as shown. At the site, this gap is filled with a fire rated caulk. The longitudinal gap between the inner pre-finished gypsum on the exterior wall of module 220 and the pre-finished ceiling 20 of floor/ceiling assembly 10 of module 218 is sealed with an application of ⅝" type X gypsum. This added length of gypsum is then covered with a decorative trim 58. The exterior of the gap is sealed in accordance with the instructions of the manufacturer of the stucco cement system 212. At certain locations an exterior trim 252 may also be applied.

Figure 35:
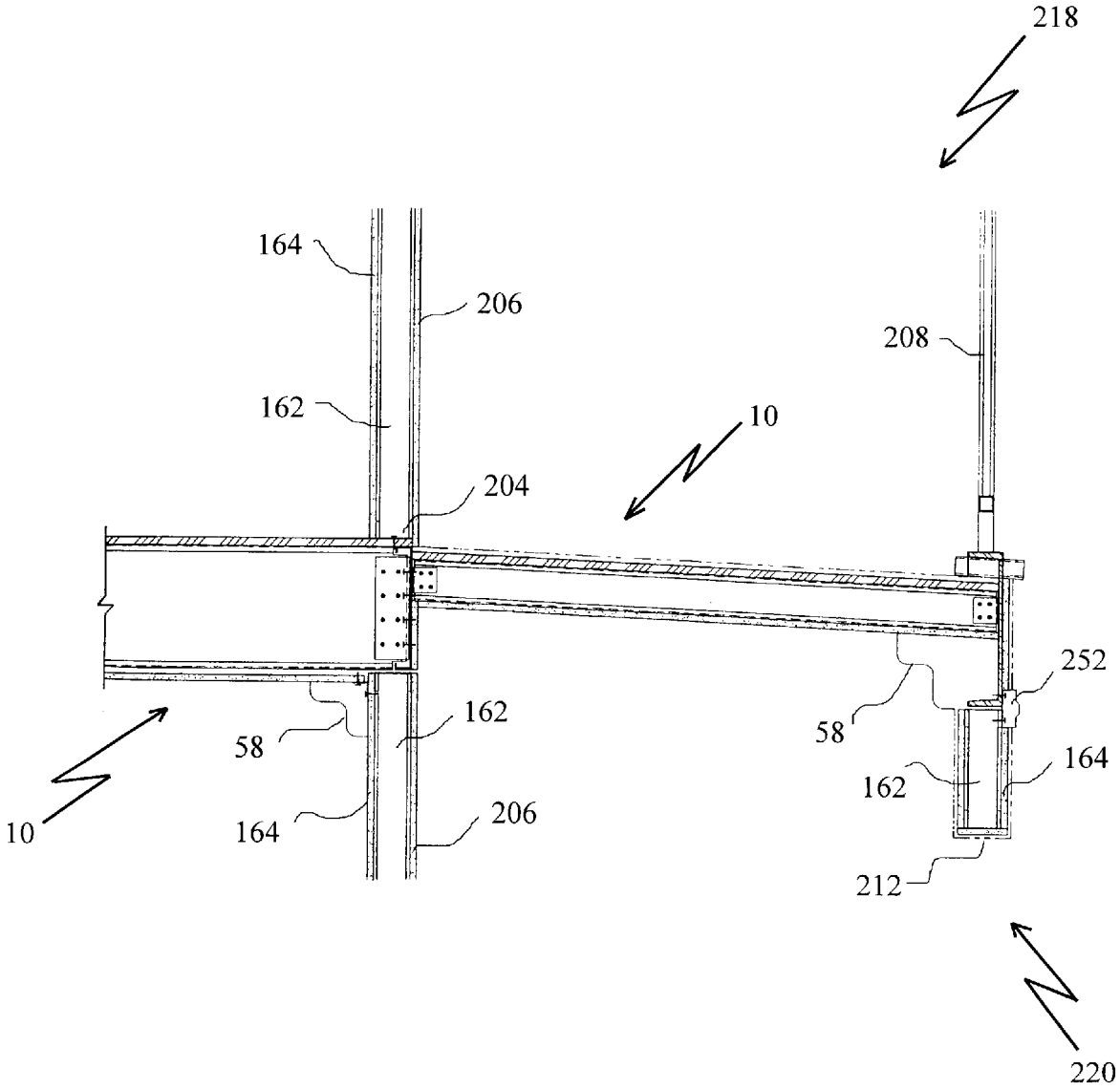
FIG. 35 illustrates sectional details of a pre-finished exterior and railing walls where they are attached to a floor/ceiling assembly at a balcony.

FIG. 35 illustrates a typical finish at the connection of an upper module 218 and a lower module 220 at sectional view 34 (see FIGS. 6 and 8) of exterior balcony 244. The vertical wall shown as part of module 218 was attached and finished at the factory. The wall includes studs 162, gypsum 164, and insulation (not shown). At this location, a cement wallboard 206 that provides more durability during frequent physical contact is used for the exterior surface of the wall. This wallboard 206 was also pre-finished at the factory. Likewise railings 208 were added to the module at the factory to complete the balcony 244. The connection between the pre-finished ceiling in module 218 and the wall of module 220 is finished at the site as described for FIG. 34. After the short horizontal header wall that is part of the balcony 244 on module 220 is attached to the perimeter joist 12 that is part of module 218, the interior web of the perimeter joist is fireproofed and also covered with a crown molding 58.

VII. Construction of Building 210

Figure 28:
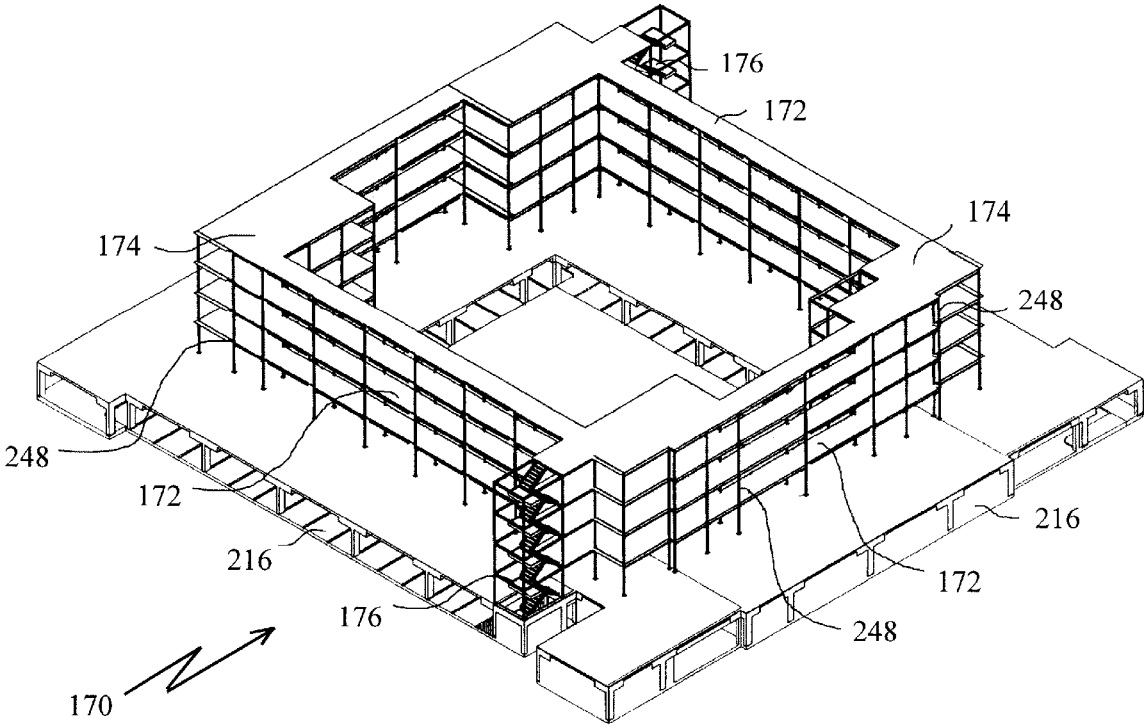
FIG. 28 illustrates one embodiment of the stabilization assembly of the present invention.

The construction of building 210 begins with the erection of the stabilization assembly 170 as illustrated in FIG. 28. As in FIG. 3, shown are the main components of the stabilization assembly, including the four corridors 172 on each floor of the building, the four corridor landings 174 on each floor at the corners of the building, and the two sets of stairs 176. The structural steel framing 248 is shown as it typically appears before the modules are placed on and attached to the stabilization assembly 170; the configuration of the steel framing varies from site to site. The design of the concrete foundation for the stabilization assembly also varies from site to site based on factors such as soil conditions, building height, building codes, etc. In this embodiment, a parking deck 216 is incorporated that functions both as part of the building's foundation and as a secure place for the residents to park and gain access to their apartments. Engineering for the design of any specific foundation is based on techniques currently available to the art.

Figure 36:
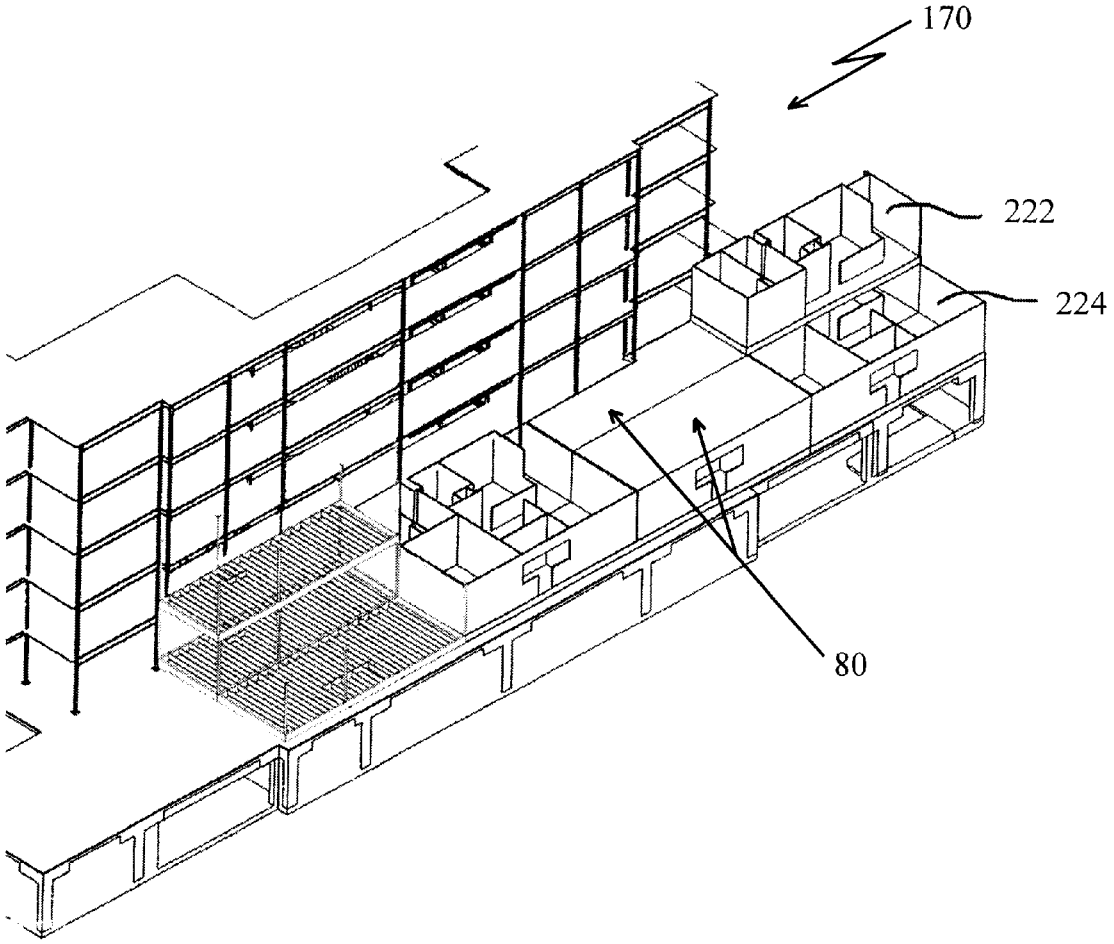
FIG. 36 illustrates the placement of several apartment modules on the stabilization assembly of FIG. 28.

Erection and placement of the modules on stabilization assembly 170 is illustrated in FIG. 36. All of the modules for the lower floors are delivered pre-finished from the factory with temporary lifting-transportation roof assemblies 80 attached to each module. "Wet" modules 222 are placed on and attached to the stabilization assembly 170 before "dry" modules 224 are set in place. Since part of the function of the temporary roof assembly 80 is to keep the modules sealed from the weather, the temporary roof assembly 80 typically remains attached until another module is ready to be set on the module already placed. Then the temporary roof assembly 80 is removed and shipped back to the factory for re-use on the construction of another module.

FIG. 36 further illustrates a set of modules 222 and 224 wherein the vertical support assemblies 60 and the structural framing from the floor/ceiling assemblies 10 are isolated, as this set of modules is presented in FIG. 17.

Modules used for the top floor of building 210 do not make use of the temporary roof assembly 80. These modules have a permanent roof assembly 140 attached in the factory. The generic roof membrane system 214 is pre-finished as part of the permanent roof assemblies 140. When all of the top floor modules are in place, the pre-finished membrane roofs 214 on the individual modules are joined making one continuous sealed roof membrane for the entire building.

Figure 37:
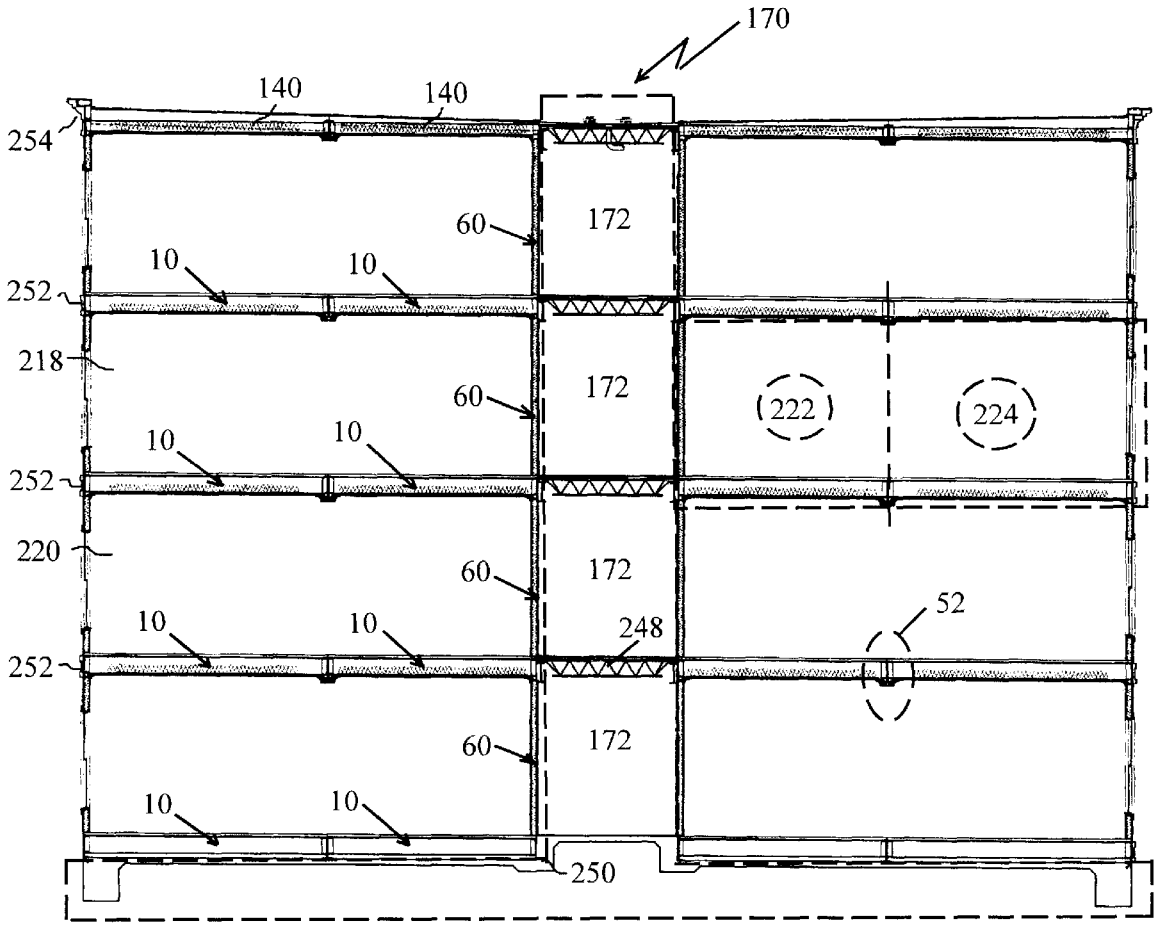
FIG. 37 illustrates a section of a building showing a relationship of the stabilization assembly of FIG. 28 to attached pre-finished modules.

A section of building 210 at one of the corridors 172 is illustrated in FIG. 37. This section shows the interrelationship of the various components of the building. Stabilization assembly 170 forms the center core of the building that at this section includes portions of the structural steel framing 248 and the foundation 250. Eight modules 222 have been attached to the stabilization assembly 170, four on each side. Eight modules 224 have been attached to the exterior side of the modules 222. The use of floor/ceiling assemblies 10 and load-bearing assemblies 60 are shown. The permanent roof assemblies 140 are shown as part of the top floor modules. Two areas of site work are shown, the exterior trim molding 252 that is used as part of the seal between two vertical modules and the crown molding 254 that is a design feature to enhance the aesthetic attractiveness of the building.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. In a construction system for a structure, the structure being formed of manufactured housing units, the construction system including plumbing, electrical and structural infrastructures for the structure, an improvement to the construction system comprising:

manufactured housing units that are approximately at least majority-finished at a manufacturing site distant the building site of the structure, the units being transported as approximately at least majority-finished from the manufacturing site to the building site and assembled together to form the structure; and a floor/ceiling assembly locatable between vertically adjacent units, thus alleviating the need for each unit to be built at the manufacturing site with a separate floor and ceiling, the floor/ceiling assembly incorporating:

(a) structural members with top and bottom flanges;

(b) a floor in communication with the top flanges;

(c) a sound attenuation member in communication with the bottom flanges; and (d) a ceiling in communication with either or both of the top flanges and the sound attenuation member.

2. The construction system of claim 1, the floor/ceiling assembly further comprising:

(a) a balcony portion that is open to the environment upon construction of the structure; and (b) an interconnection system enabling the connection of units at the budding site, which interconnection assembly does nor significantly inhibit the finishing of the units at the manufacturing site.

3. The construction system of claim 2, the interconnection system being a non-welding connection means.

4. The construction system of claim 1, further comprising a load-bearing assembly for a unit, the load-bearing assembly to transfer at least a majority of the loads of the structure, thus freeing the walls of the units from such load transfer, enabling the walls of the units to be approximately at least majority-finished distant from the building site of the structure.

5. The construction system of claim 4, the load-bearing assembly comprising:

(a) load-beating members; and (b) connection subassemblies to connect the load-bearing members of two adjacent units.

6. The construction system of claim 5, the load-bearing members being at least approximately vertical members and the connection subassemblies connecting the at least approximately vertical members of two vertically adjacent units.

7. The construction system of claim 6, the vertical members of the load-bearing assembly each being of approximately the same size.

8. The construction system of claim 4 further comprising a temporary roof assembly to protect the approximately at least majority-finished unit during transit to the building site, the temporary roof assembly removable from the unit prior to completion of the structure, the temporary roof assembly attached to the load-bearing assembly of the unit.

9. The construction system of claim 1, further comprising a temporary roof assembly to protect the approximately at least majority-finished unit during transit to the building site, the temporary roof assembly removable from the unit prior to completion of the structure.

10. The construction system of claim 9, the temporary roof assembly including a lifting assembly by which the unit can be lifted and placed during construction of the structure.

11. The construction system of claim 1, further compromising a permanent roof assembly locatable on majority-finished units making up at least a portion of a top floor of the structure.

12. The construction system of claim 1 further comprising a stabilization assembly erected at the building site, the stabilization assembly providing a stable construction assembly to which the units can be attached during construction of the structure.

13. The construction system of claim 12, the stabilization assembly comprising a moment-resistant framework.

* * * * *